US011597588B2

(12) United States Patent
Luis y Prado

(10) Patent No.: US 11,597,588 B2
(45) Date of Patent: Mar. 7, 2023

(54) MODULAR STRUCTURE SYSTEMS

(71) Applicant: Workshops for Warriors, San Diego, CA (US)

(72) Inventor: Hernán Luis y Prado, San Diego, CA (US)

(73) Assignee: Workshops for Warriors, San Diego, CA (US)

( * ) Notice: Subject to any disclaimer, the term of this patent is extended or adjusted under 35 U.S.C. 154(b) by 413 days.

(21) Appl. No.: 16/870,380

(22) Filed: May 8, 2020

(65) Prior Publication Data

US 2021/0347560 A1 Nov. 11, 2021

(51) Int. Cl.

| | |
|---|---|
| ***B65D 88/02*** | (2006.01) |
| ***B65D 6/00*** | (2006.01) |
| ***B65D 88/12*** | (2006.01) |
| *B65D 88/52* | (2006.01) |

(52) U.S. Cl.

CPC ..... *B65D 88/022* (2013.01); *B65D 7/12* (2013.01); *B65D 88/121* (2013.01); *B65D 88/129* (2013.01); *B65D 88/522* (2013.01); *B65D 2588/02* (2013.01); *B65D 2590/0008* (2013.01); *B65D 2590/02* (2013.01)

(58) Field of Classification Search

CPC ..... B65D 2501/24554; B65D 88/022; B65D 7/12; B65D 88/121; B65D 88/129; B65D 88/522; B65D 2588/02; B65D 2590/0008; B65D 2590/02; E04B 1/34861; E04B 2001/34876; E04B 2001/34892; E04B 1/3483

See application file for complete search history.

(56) References Cited

U.S. PATENT DOCUMENTS

| | | | | |
|---|---|---|---|---|
| 3,966,075 | A * | 6/1976 | Schultz | B65D 88/025 220/8 |
| 6,227,397 | B1 * | 5/2001 | Kim | B65D 88/121 220/8 |
| 7,762,417 | B2 * | 7/2010 | Arnold | B65D 85/68 220/4.03 |
| 10,337,184 | B2 * | 7/2019 | Coupe | E04B 1/34315 |
| 10,518,968 | B2 * | 12/2019 | Lee | B65D 88/027 |
| 10,822,163 | B2 * | 11/2020 | Ptochos | B65D 90/08 |
| 10,870,514 | B2 * | 12/2020 | Burke | B65D 88/121 |
| 11,230,853 | B2 * | 1/2022 | Speciale | E04H 7/04 |

(Continued)

*Primary Examiner* — Kareen K Thomas
(74) *Attorney, Agent, or Firm* — Fish & Richardson P.C.

(57) ABSTRACT

A modular structure system includes a plurality of shipping containers arranged to form a contiguous enclosure comprising an interior volume of the plurality of shipping containers, wherein each of the plurality of shipping containers comprises a first side defining an opening configured to be arranged opposite and adjacent to a corresponding opening in a first side of a different shipping container of the plurality to form the contiguous enclosure; a bottom group of the plurality of shipping containers including bottom sides having floor sections arranged to form a bottom floor of the modular structure; a top group of the plurality of shipping containers including top sides having ceiling sections arranged to form a top ceiling of the modular structure; and a side group of the plurality of shipping containers comprising a second side having a side wall arranged to form exterior right and left side walls of the modular structure.

34 Claims, 24 Drawing Sheets

(56) References Cited

U.S. PATENT DOCUMENTS

| | | | | |
|---|---|---|---|---|
| 2008/0251513 | A1* | 10/2008 | Vatn | B65D 21/086 220/8 |
| 2010/0025407 | A1* | 2/2010 | Benson | B65D 90/042 29/401.1 |
| 2011/0297675 | A1* | 12/2011 | Johnson | B60P 3/14 220/8 |
| 2015/0008218 | A1* | 1/2015 | Lupul | B65D 90/16 220/8 |
| 2015/0034634 | A1* | 2/2015 | Mullaney | B28B 13/00 52/79.5 |
| 2018/0201439 | A1* | 7/2018 | Battles | B65G 1/026 |
| 2018/0201445 | A1* | 7/2018 | Battles | B65G 1/1373 |
| 2019/0210902 | A1* | 7/2019 | Sassow | C12M 23/36 |
| 2019/0376276 | A1* | 12/2019 | Lucho Do Valle | E04B 1/34336 |
| 2020/0140142 | A1* | 5/2020 | Erickson | B65D 11/1873 |
| 2022/0234817 | A1* | 7/2022 | Gunn | B65D 88/022 |

* cited by examiner

Left View

Container 1, top Container 2, top

Container 1, x-section Container 2, x-section

MODULAR STRUCTURE SYSTEMS

TECHNICAL FIELD

This specification relates to modular structure systems such as, for example, engineered building systems.

BACKGROUND

Building and construction is impacted, in some cases, by the location at which the building and construction is to occur. For example, rough terrain or remote locations often cause problems, such as expense and time, for building and constructing habitations (and other buildings). Natural disasters, an outbreak of communicable diseases, or social unrest may require the rapid creation, transportation, and setup of rigid easily deployable prebuilt structures for communication, emergency response, or decontamination.

SUMMARY

In an example implementation, a modular structure includes a first shipping container that includes an inner cavity, an open side with four corners, each a corner including a corner casting, and an inner flashing secured around an inner periphery of the open side, the inner flashing extending away from the open side. The modular structure further includes a second shipping container positioned adjacent to the first shipping container and including an inner cavity, and an open side with four corners, each corner including a corner casting, the open side of the second shipping container arranged opposite to the open side of the first shipping container. The modular structure further includes an enclosure defined by the inner cavities of the first and second shipping containers and the inner flashing. Each of the four corner castings of the first shipping container is located opposite and adjacent to a respective one of the four corner castings of the second shipping container. The open sides of the first and second shipping containers define a peripheral gap therebetween, the peripheral gap being covered in the enclosure by the inner flashing.

An aspect combinable with the example implementation further includes at least one fastener that secures a corner casting of the first shipping container to a respective corner casting of the second shipping container.

In another aspect combinable with any one of the previous aspects, the fastener is arranged to define a width of the peripheral gap.

In another aspect combinable with any one of the previous aspects, the fastener is an adjustable fastener operable to adjust the width of the peripheral gap.

In another aspect combinable with any one of the previous aspects, the open side of the second shipping container includes an outer flashing secured around an outer periphery of the open side.

In another aspect combinable with any one of the previous aspects, the outer flashing extends away from the open side.

In another aspect combinable with any one of the previous aspects, the outer flashing covers an exterior portion of the peripheral gap and defines a portion of an exterior surface of the modular structure.

In another aspect combinable with any one of the previous aspects, the inner flashing and the outer flashing define a gasket region there between, and a volume of the gasket region is defined by a width of the peripheral gap.

In another aspect combinable with any one of the previous aspects, the modular structure includes a gasket material disposed in the gasket region for sealing the enclosure of the modular structure.

In another aspect combinable with any one of the previous aspects, the inner flashing and the outer flashing extend in parallel directions.

In another aspect combinable with any one of the previous aspects, the inner flashing extends into the opening of the second shipping container.

In another aspect combinable with any one of the previous aspects, the outer flashing extends around an outer periphery of the first shipping container.

In another aspect combinable with any one of the previous aspects, one of the first and second shipping containers includes an external outlet configured to provide a utility connection to the modular structure.

An aspect combinable with any one of the previous aspects further includes a third shipping container including an inner cavity, and an open side with four corners, each corner of the four corners including a corner casting.

In another aspect combinable with any one of the previous aspects, the open side of the first shipping container is a first open side, the first shipping container further includes a second open side opposite the first open side, and the open side of the third shipping container is arranged opposite to the second open side of the first shipping container.

In another aspect combinable with any one of the previous aspects, the inner flashing is a first inner flashing, and a second inner flashing is secured around an inner periphery of the open side of the third shipping container or around the inner periphery of the second open side of the first shipping container.

In another aspect combinable with any one of the previous aspects, the second inner flashing covers a peripheral gap between the first and third shipping containers such that the enclosure of the modular structure is defined by the inner cavities of the first, second, and third shipping containers and the first and second inner flashings.

In another aspect combinable with any one of the previous aspects, at least one of the first or second shipping containers includes a set of sealable barn doors mounted on the open side to enclose the inner cavity; and an interior door assembly mounted within the inner cavity to partition the inner cavity into a first volume and a second volume.

In another aspect combinable with any one of the previous aspects, the first volume includes a contaminated area between the set of sealable barn doors and the interior door assembly, and the second volume includes a decontaminated area between the interior door assembly and a closed side of the inner cavity opposite the open side.

In another aspect combinable with any one of the previous aspects, the interior door assembly includes a wing frame assembly attached to a frame of the set of sealable barn doors and an interior door mounted to the wing frame assembly.

Another aspect combinable with any one of the previous aspects further includes a second interior door assembly mounted within the inner cavity to partition the inner cavity into the first volume, the second volume, and a third volume.

In another aspect combinable with any one of the previous aspects, the first volume includes the contaminated area between the set of sealable barn doors and the first interior door assembly, the second volume includes the decontaminated area between the first interior door assembly and the second interior door assembly, and the third volume includes a clean area between the second interior door assembly and the closed side of the inner cavity opposite the open side.

In another example implementation, a modular structure system includes a plurality of shipping containers arranged to form a contiguous enclosure including an interior volume of the plurality of shipping containers, wherein each of the plurality of shipping containers includes a first side defining an opening configured to be arranged opposite and adjacent to a corresponding opening in a first side of a different shipping container of the plurality to form the contiguous enclosure; a bottom group of the plurality of shipping containers including bottom sides having floor sections arranged to form a bottom floor of the modular structure; a top group of the plurality of shipping containers including top sides having ceiling sections arranged to form a top ceiling of the modular structure; and a side group of the plurality of shipping containers including a second side having a side wall arranged to form exterior right and left side walls of the modular structure.

In an aspect combinable with the example implementation, the modular structure defines an exterior surface including the walls of the plurality of shipping containers facing the exterior of the modular structure.

In another aspect combinable with any one of the previous aspects, the walls of the plurality of shipping containers forming the exterior surface include an insulating material disposed on an inner surface of the walls.

In another aspect combinable with any one of the previous aspects, the plurality of shipping containers are configured to be arranged and secure longitudinally adjacent to each other.

In another aspect combinable with any one of the previous aspects, each shipping container includes eight corners that include corner castings.

In another aspect combinable with any one of the previous aspects, each shipping containers is secured to one or more adjacent shipping containers by fasteners.

In another aspect combinable with any one of the previous aspects, each fastener secures a corner of each shipping container to an adjacent and opposite corner of one of the one or more adjacent shipping containers.

In another aspect combinable with any one of the previous aspects, an interior group of the plurality of shipping containers includes a second side with an opening opposite the opening of the first side.

In another aspect combinable with any one of the previous aspects, the openings in the first sides span the entire first sides.

In another aspect combinable with any one of the previous aspects, one or more shipping containers includes an exterior outlet configured to provide a utility connection to the modular structure.

In another example implementation, a shipping container for use in a modular structure includes a bottom side including a floor; a top side including a ceiling defining an opening in the ceiling with a removable portion of the ceiling covering the opening in a first configuration; an enclosure defining an interior region of the shipping container between the floor and the an enclosure; a staircase in the enclosure and spanning from the floor to the ceiling below the removable portion of the ceiling, wherein the removable portion is sized and shaped to enable a use to walk up the staircase and though the opening in the ceiling in a second configuration when the removable portion of the ceiling is absent.

In an aspect combinable with the example implementation, the opening in the ceiling in a first opening.

In another aspect combinable with any one of the previous aspects, the floor defines a second opening directly below the first opening and of the same size and shape as the first opening in the ceiling.

In another aspect combinable with any one of the previous aspects, the floor includes a removable portion covering the second opening in a first configuration.

In another aspect combinable with any one of the previous aspects, in a second configuration, the removable portion of the floor is absent and the second opening enables a user to enter the shipping container from a staircase in a shipping container position below the second opening.

In another example implementation, a method for joining shipping containers together to create a modular structure includes providing a first shipping container and a second shipping container, each shipping container defining a side with four corners and an inner volume, wherein each corner includes a corner casting; removing a wall of the side of the first shipper container to create a first opening; removing a wall of the side of the second shipping container to create a second opening; positioning the first opening adjacent and opposite to the second opening; aligning the first opening with the second opening such that each corner castings of the first container is adjacent and opposite to a respective corner castings of the second shipping container, the aligning defining a peripheral gap between the sides of the first and second shipping containers; after the aligning, securing the first shipping container to the second shipping container to create the modular structure by securing each corner casting of the first shipping container to the respective corner casting of the second shipping container to constrain a width of the peripheral gap; and securing an inner flashing around an inner periphery of the first opening, wherein, when the first and second shipping containers are secured, the inner flashing extending into the second opening and covering the peripheral gap to define a portion of an enclosure of the modular structure including the inner volumes of the first and second shipping containers.

In an aspect combinable with the example implementation, securing each corner casting of the first shipping container to the respective corner casting of the second shipping container includes securing each adjacent pair of corner castings with an adjustable fastener, the adjustable faster enabling the width of the peripheral gap to be adjusted by operating the adjustable fasteners.

Another aspect combinable with any one of the previous aspects further includes securing an outer flashing around the an outer periphery of the second opening, wherein, when the first and second shipping containers are secured, the outer flashing extending around the first shipping container and covering the peripheral gap to define a portion of an exterior of the modular structure.

In another aspect combinable with any one of the previous aspects, the peripheral gap defines a gasket volume between the inner and outer flashings, the method further including disposing a gasket material in the gasket volume, the gasket material creating a seal between the inner and outer flashing to seal the enclosure modular structure at the location of the gap.

Another aspect combinable with any one of the previous aspects further includes: after filling the sealing volume with the gasket material and securing the first shipping container to the second shipping container with the adjustable fastener, operating the adjustable fastener to reduce the width of the gap; and reducing, by operating the adjustable fastener, the gasket volume between the inner and outer flashings to fill the gasket volume with the gasket material; and sealing, by reducing the gasket volume, the modular structure at the gap.

Details of one or more implementations of the subject matter described in this specification are set forth in the accompanying drawings and the description below. Other features, aspects, and potential advantages of the subject matter will become apparent from the description, the drawings, and the claims.

BRIEF DESCRIPTION OF THE DRAWINGS

Like reference symbols may refer to like components. Also, features shown or described with reference to a particular modular structure or system may also be included on other modular structures or systems even if such features are not shown on such modular structures or systems.

DETAILED DESCRIPTION

Figure 1A:
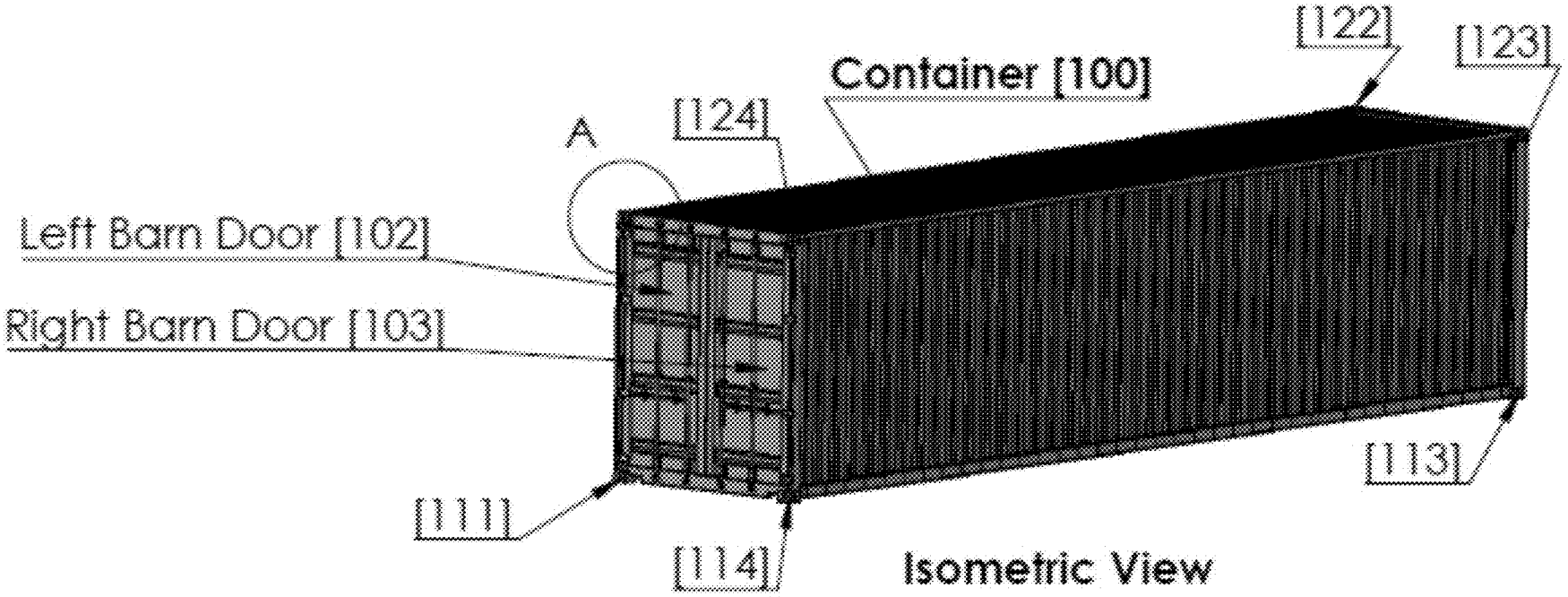
FIGS. 1A-1D are isometric, front, rear, and back views of a modular structure according to implementations of the present disclosure.
Figure 1B:
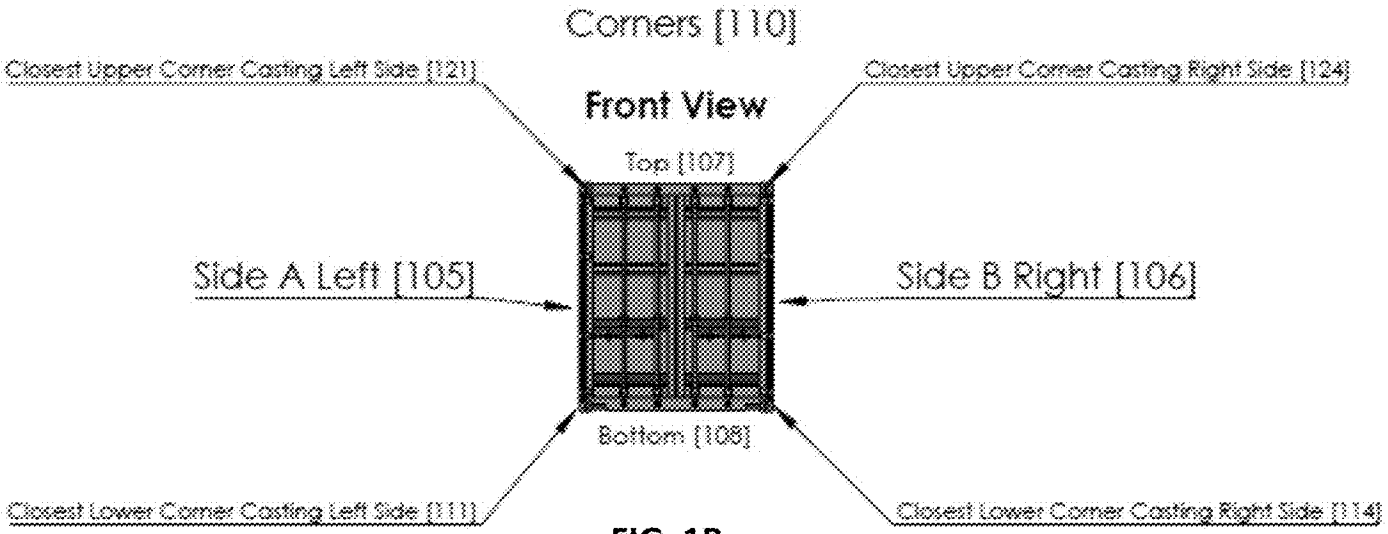
Figure 1C:
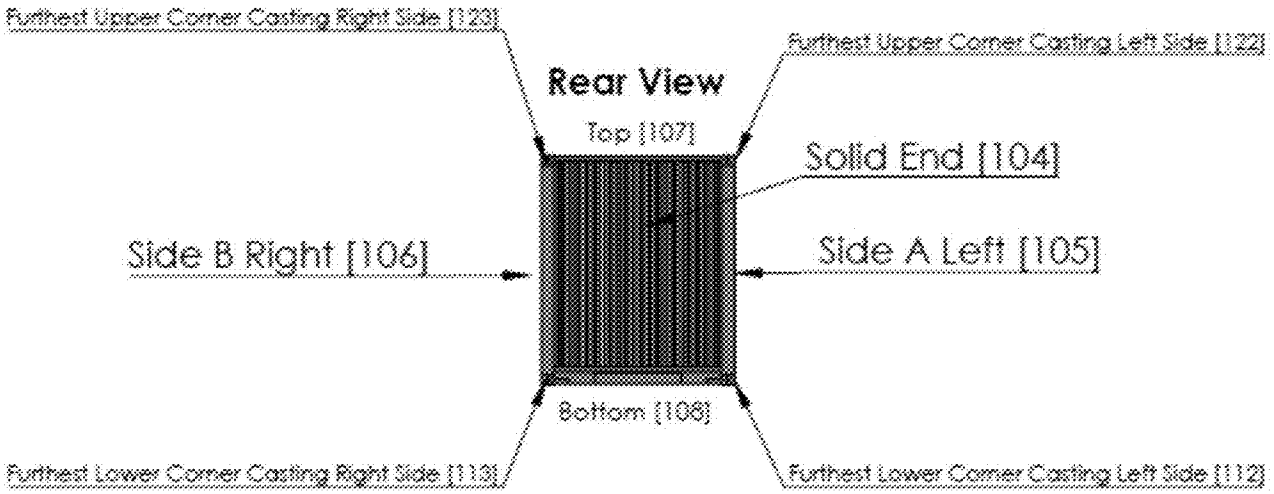
Figure 1D:
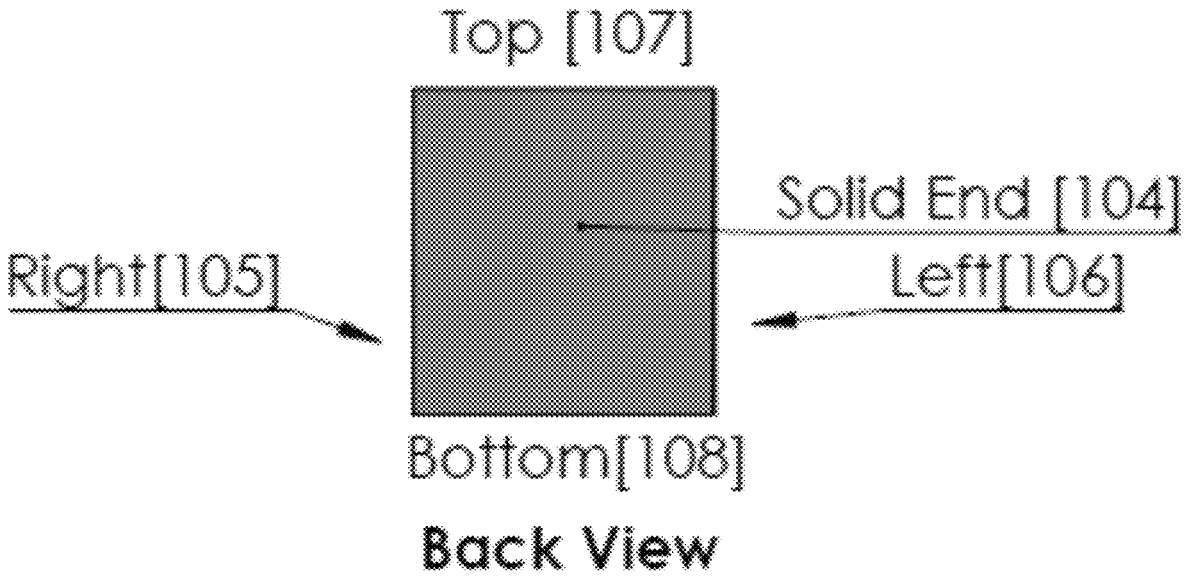

The present disclosure described modular structure systems and methods therefor. In some implementations, a modular structure system may include a modular structure, such as a shipping container. The shipping container, in some aspects, may be an intermodal shipping container governed by the ISO 6346 standard, otherwise known as an ISO shipping container. In some aspects, each modular structure is an ISO shipping container of a particular, standardized size. Such sizes include, for example, 40' long by 8' wide by 8' tall (Regular 40' ISO) also referred to as "40' Container"; 40' long by 8' wide by 9.5" tall (High Cube 40' ISO) also referred to as "40' Container"; or 20' long by 8' wide by 8' tall (Regular 20' ISO) also referred to as "20" ISO Container." In some aspects, one or more of the modular structures is a "one-trip" shipping container, e.g., an ISO shipping container that has been transported a single trip.

Other containers besides ISO shipping containers may form the basis of one or more of the modular structures. For example, any container that may be modified, e.g., by removing what is not needed (sides, roofs, floors, doors, etc.) and adding what is desired (HVAC, electrical connections, Network and Telephone Connections, Potable Water, Grey water, Black Water, Chill Water, and Heated Water/Steam) to construct a modular structure system are contemplated by the present disclosure. In addition, such modular structures, such as ISO shipping containers, may be transported via truck, rail, ship, and helicopter to wherever they are needed.

One or more modular structures (as described in more detail herein) may include utility connections. In some aspect utility connections includes any combination of the following available utilities that are required in a building, aircraft or other vessel/structure that would be connected/interconnected between any combination of the modular structures in order to accommodate environmental conditions required for humans, as well as other flora, and fauna, or experiments, systems that require specialized environments: power (may be three phase, single phase, DC, or AC, or any combination); HVAC (heating ventilation, air conditioning, filters, back pressure systems); CPS (Collective Protection Systems) for NBC and HAZMAT applications; oxygen generation and distribution systems as well as humidifiers, dehumidifiers, $CO_2$ scrubbers and other environmental control systems; network (radar and microwave wave guides, low and high voltage Cat5/6, etc. network cabling, fiber optics, telephone, and other network communication systems); piping/tubing for water (e.g., potable, grey, black, contaminated, high pressure, steam, etc.); drainage (for water, other fluids (chemicals, etc.); air and other compressed gases (e.g., oxygen, hydrogen, welding/manufacturing gases, etc.); and physical communication systems (vacuum tubes, messenger chutes, money/mail transfer chutes, etc.).

FIGS. 1A-1D are isometric, front, rear, and back views of a modular structure 100 according to implementations of the present disclosure. In these figures, the modular structure is an ISO shipping container 100. The ISO shipping container 100 includes, as shown, a door (or front) end that includes left and right doors 102 and 103. The ISO shipping container 100 also includes a left side A 105 and a right side B 106. A rear or back side 104 is solid in this example, e.g., does not include doors or other ingress. As further shown the ISO shipping container 100 includes a top side 110 and a bottom side 108. In this example modular structure 100, the top 107 and bottom 108 are generally rectangular and have a long axis that may be much longer (e.g., five times) than a width axis.

Figure 4A:
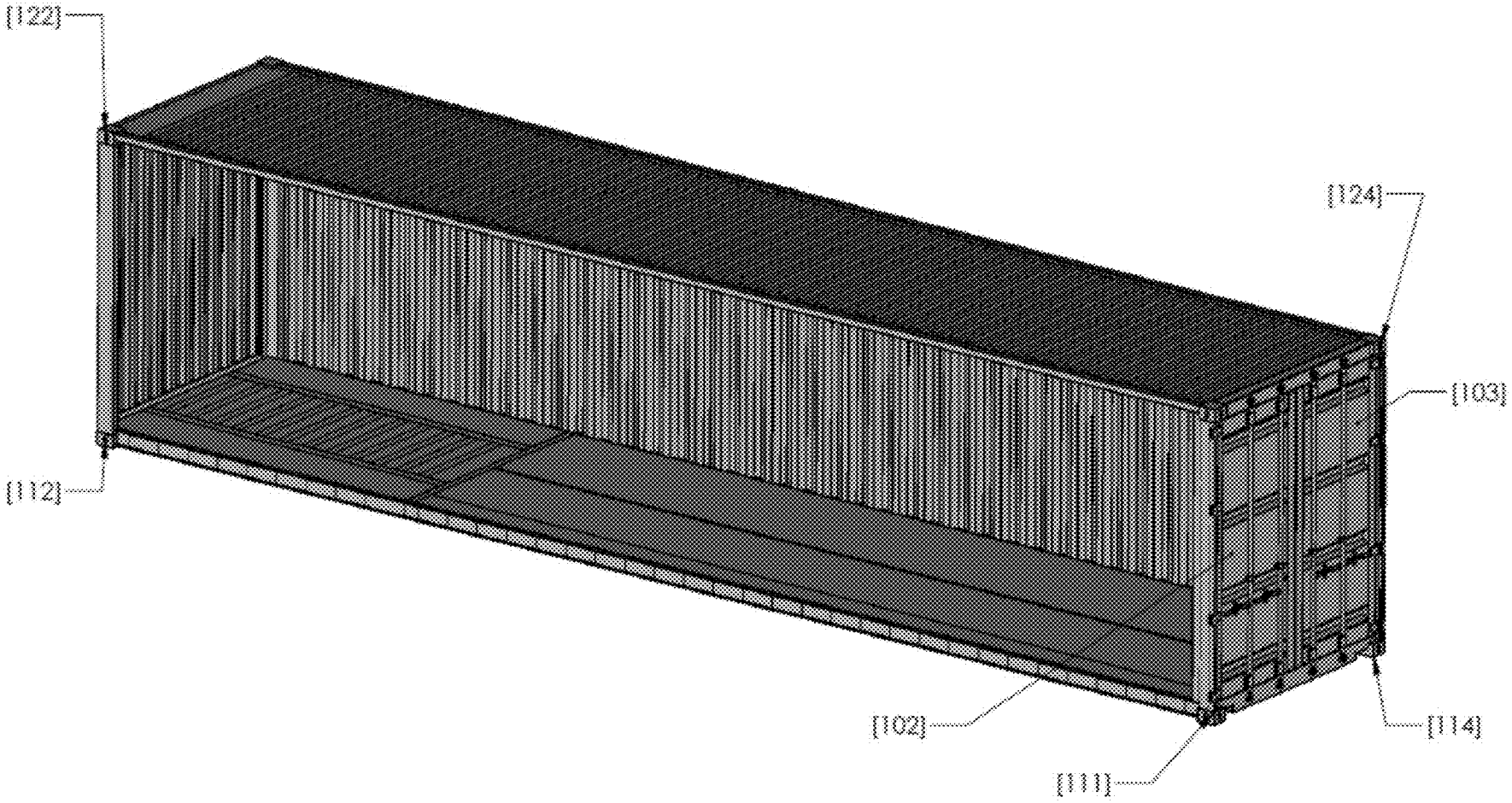
FIGS. 4A-4C are isometric, open views of another modular structure according to implementations of the present disclosure.
Figure 4B:
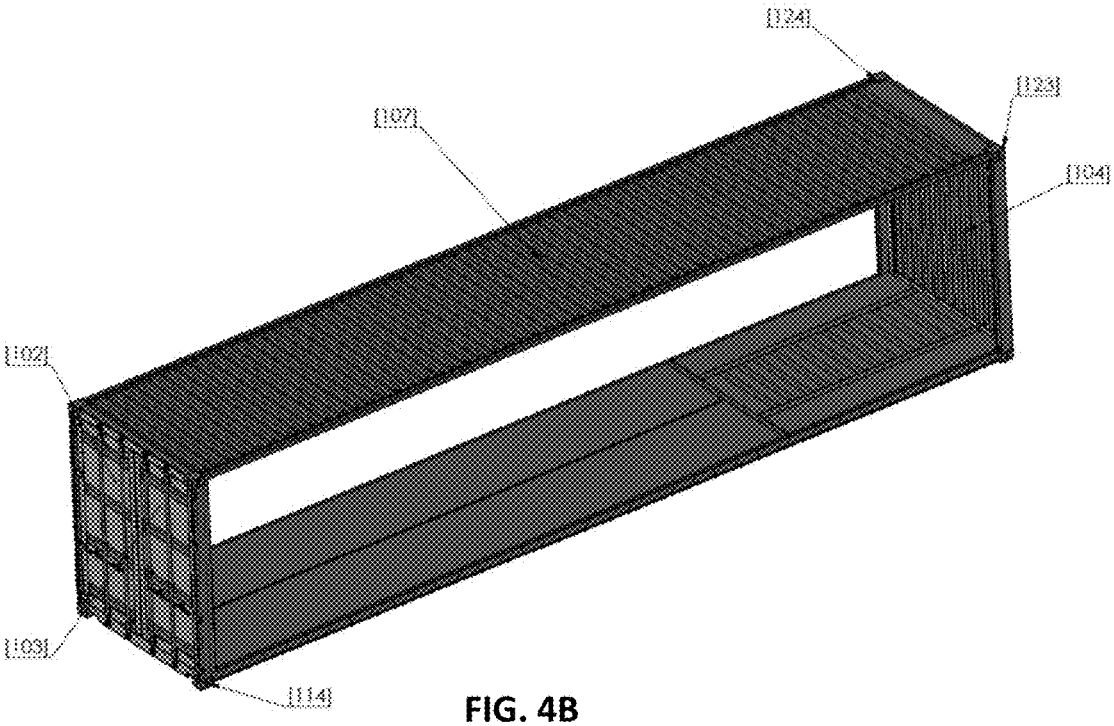
Figure 4C:
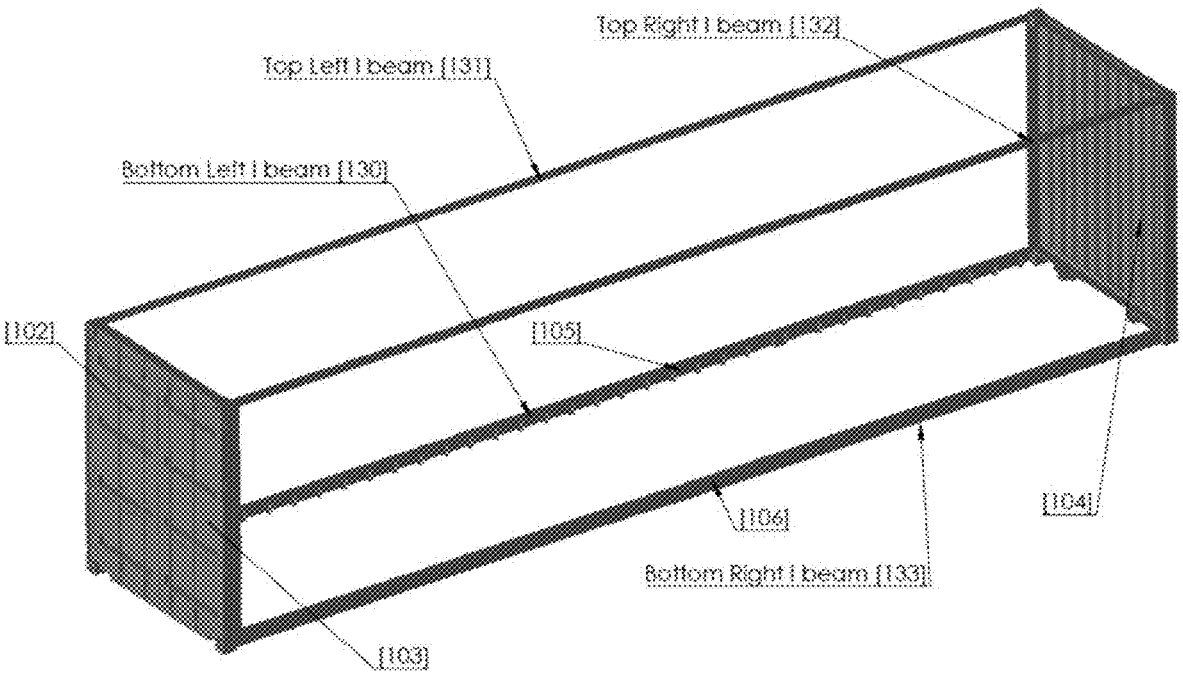

Turning briefly to FIG. 4C, this figure shows I-beams that connect the corners 110 of the modular structure 100. For example, there are four I-beams as shown: a bottom left I beam 130, a top left I beam 131, a top right I beam 132, and a bottom right I beam 133. Each particular I beam connects two corners 110.

As shown in FIGS. 1A-1D, the top 107 and bottom 108 meet the front and rear sides of the ISO shipping container 100 at corners 110. There are eight total corners 110 on the ISO shipping container 100. The upper corners 121 and 124 are located where the top 107 meets the front of the ISO shipping container 100. The upper corners 122 and 123 are located where the top 107 meets the rear of the ISO shipping container 100. The lower corners 111 and 114 are located where the bottom 108 meets the front of the ISO shipping container 100. The lower corners 113 and 112 are located where the bottom 108 meets the rear of the ISO shipping container 100.

Figure 1E:
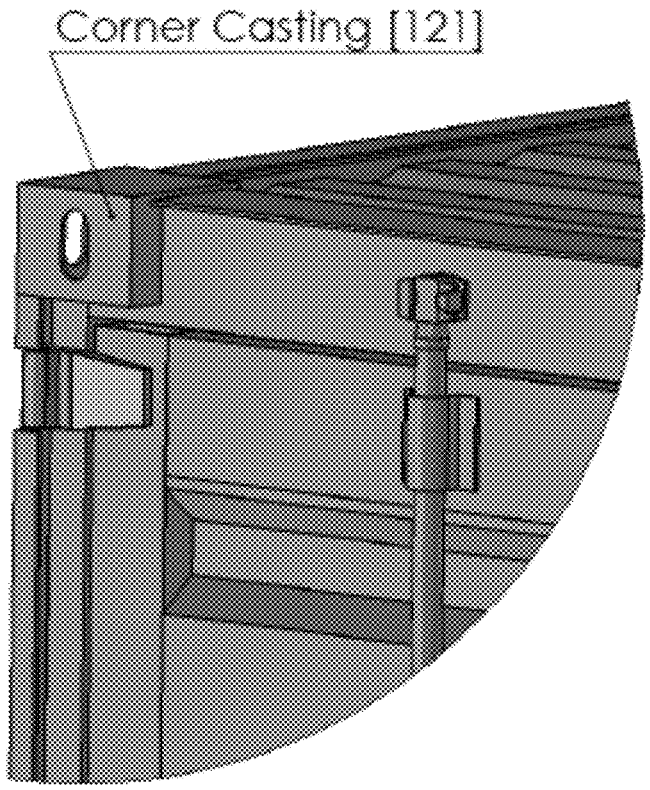
FIG. 1E is a detail of a corner of the modular structure of FIGS. 1A-1D.

FIG. 1E is a detail "A" of a particular corner 110 of the modular structure 100 of FIGS. 1A-1D. As shown, each corner 110 includes a corner casting 121. Each corner casting 121, for example, may be coupled or attached to a particular I beam to cooperatively form a frame for the modular structure 100. Thus, in some aspects, one or more sides of the modular structure 100, such as the top 107, bottom 108, left side 106, right side 105, or back 104 may be removed (e.g., wholly or partially) without substantially affecting the structure integrity of the ISO shipping container 100.

Figure 2A:
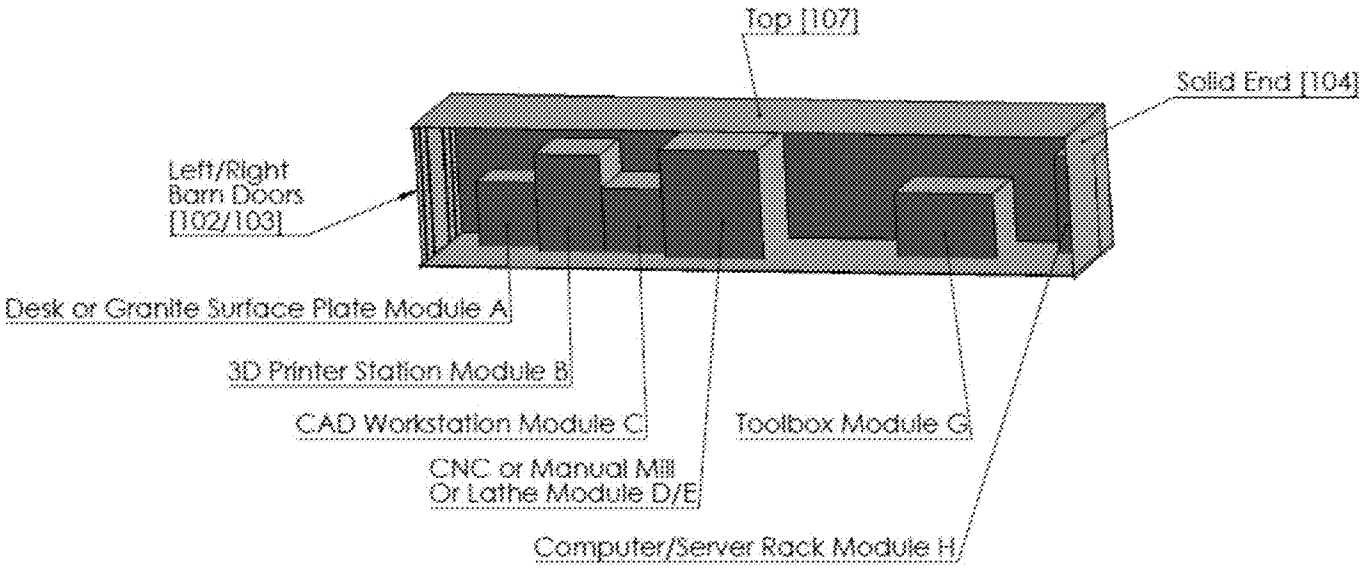
FIGS. 2A-2B are views of another modular structure according to implementations of the present disclosure.
Figure 2B:
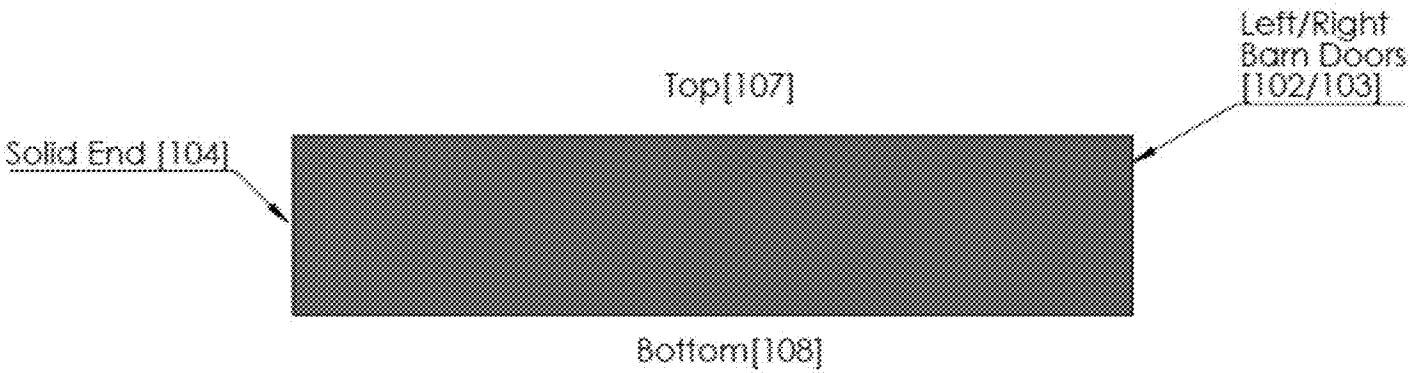

FIGS. 2A-2B are views of the modular structure 100 according to implementations of the present disclosure. For example, the modular structure 100 (or ISO shipping container 100) shown in FIGS. 2A-2B may be a modified "all-in-one" ISO shipping container 100 in which one or more appurtenances have been added to the interior volume of the structure 100. In FIG. 2A, the right side 105 has been removed, either permanently or temporarily to show the appurtenances. For example, module A (48" wide by 48" wide by 36" tall) may be, for example, a desk or granite surface plate; Module B (48" wide by 48" wide by 72" tall) may be, for example, a 3D Printer Station; Module C (48" wide by 48" wide by 48" tall) may be, for example, a CAD Workstation; Module D (72" wide by 60" deep by 80" tall) may be, for example, a CNC or Manual Mill; Module E (120" wide by 60" deep by 95" tall) may be, for example, a CNC or Manual Lathe; Module F (48" wide by 48" wide by 72" tall) may be, for example, a Portable CMM; Module G (72" wide by 48" deep by 48" tall) may be, for example, a toolbox or storage compartment; and Module H (30" wide by 30" deep by 72" tall) may be, for example, a computer/server rack.

As shown in FIG. 2B, the bottom 108 is solid, as is one of the ends 104, and the side shown in this view. The other of the ends includes left and right doors (e.g., barn doors) 102 and 103, respectively. The top 107 is also solid.

Figure 3:
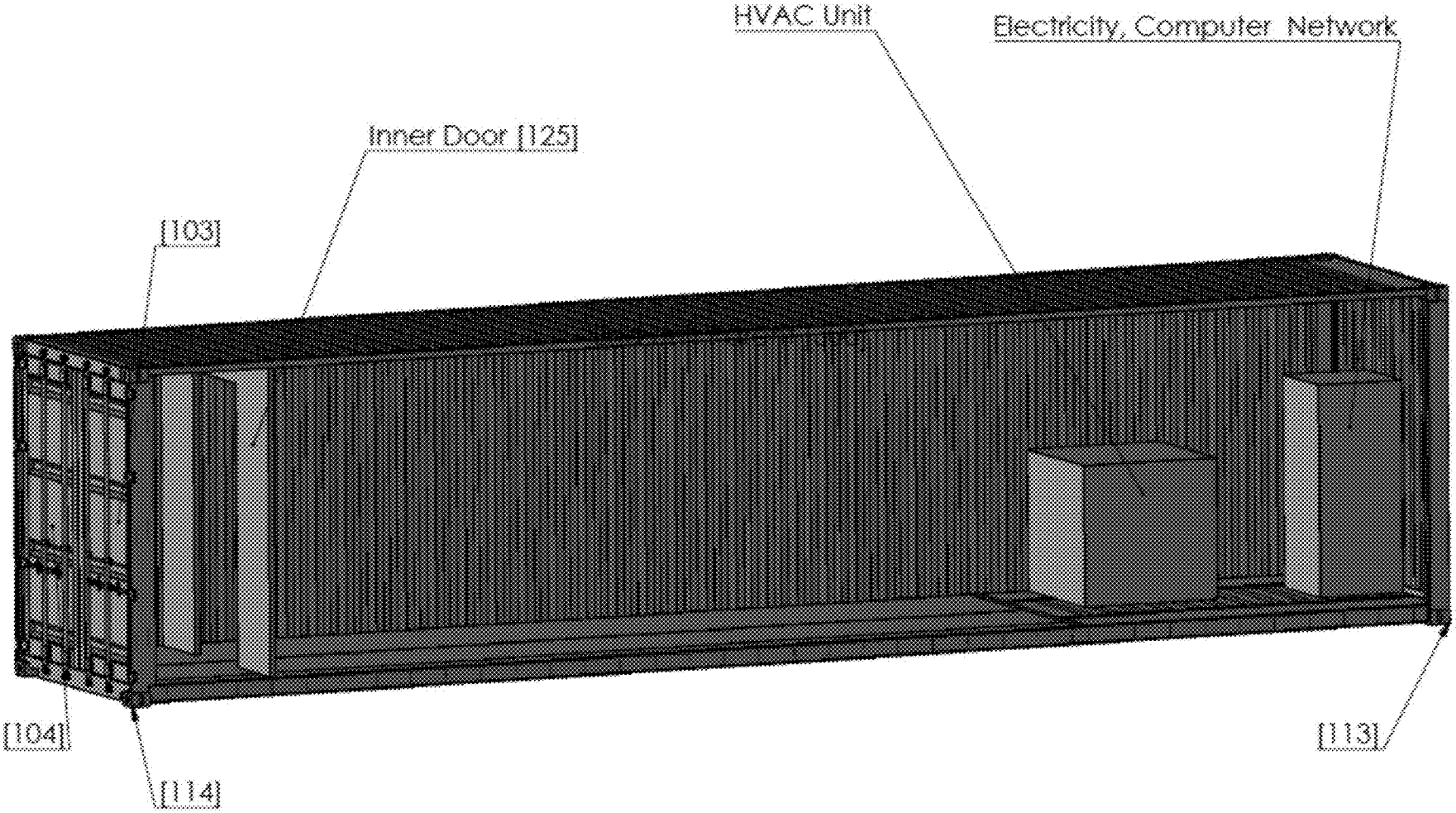
FIG. 3 is an isometric open view of another modular structure according to implementations of the present disclosure.

FIG. 3 is an isometric open view of another modular structure according to implementations of the present disclosure. In some aspects, the modular structure (e.g., ISO shipping container) shown in FIG. 3 may be considered a "parent" container that couples to one or more other "child" containers. In this example, the parent modular structure has one of its sides removed (as shown in this figure). In some aspects, other portions (another side, or top, or bottom, or combination thereof) may be removed from a parent modular structure. As shown in this example parent modular structure, an HVAC unit as well as a power and computer network module may be mounted within the structure, e.g., to provide cooling/heating and power/network to this structure as well as any child modular structures attached thereto. For example, HVAC conduit or power conduit may be installed across several child modular structures and then connected (e.g., with quick connect features) to each other and to the parent modular structure when such structures are connected. In some aspects, as shown, the parent modular structure may include an interior door 125 mounted within the inner volume of the structure to partition the inner volume into at least two, separate spaces.

In some aspects, the inner door 125 may be used to separate a "dirty" volume of the modular structure from a "clean" volume of the modular structure. For example, a volume between the inner door 125 and doors 102/103 may be considered a "dirty" volume, e.g., a volume fluidly coupled to an ambient environment through the doors 102/103, a volume in which persons or items entering the structure are considered dirty from the ambient environment (due to viral or bacterial or radioactive hazards or other). In some aspects, the inner door 125 may be fluid tight and create two separate and fluidly decoupled plenums within the structure.

In some aspects, another inner door (not shown) can be installed within the structure to the right of the inner door 125. With two inner doors, three separate plenums (e.g., fluidly decoupled volumes) may be defined within the structure. In some aspects, the plenum between the doors 102/103 and inner door 125 may be considered the "dirty" volume. The plenum between the inner door 125 and another inner door can be considered a "decontamination" volume in which "dirty" items are decontaminated. The plenum to the right of the other door can be considered the "clean" volume, into which decontaminated items may be move.

Figure 6A:
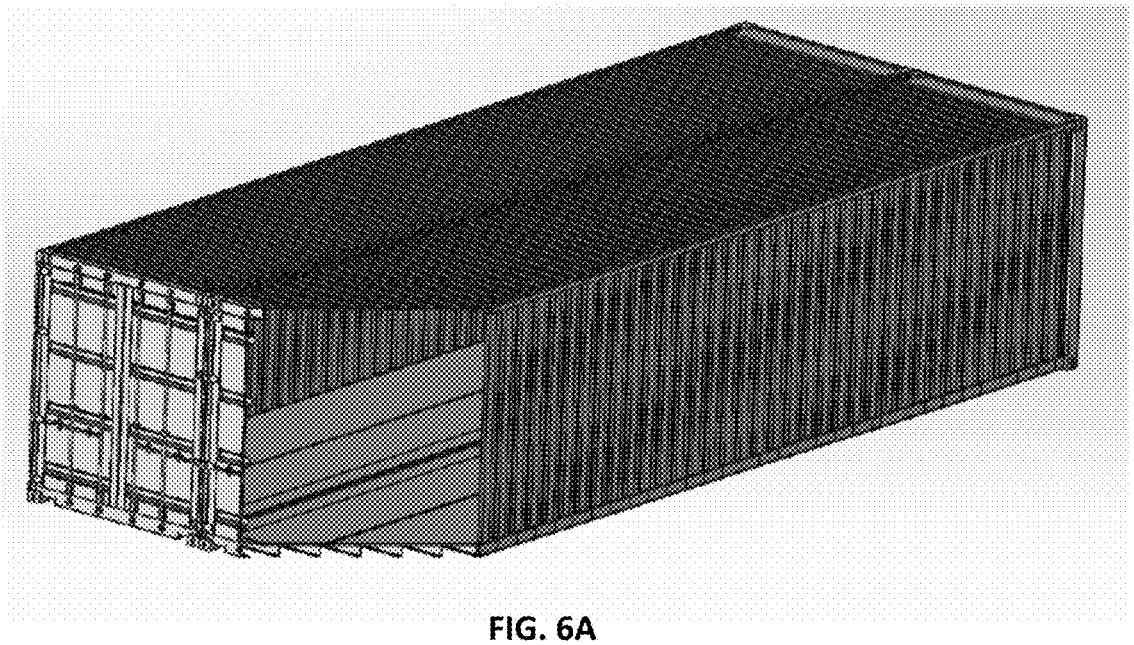
FIGS. 6A-6C are isometric views of example implementations of modular structure systems according to the present disclosure.
Figure 6B:
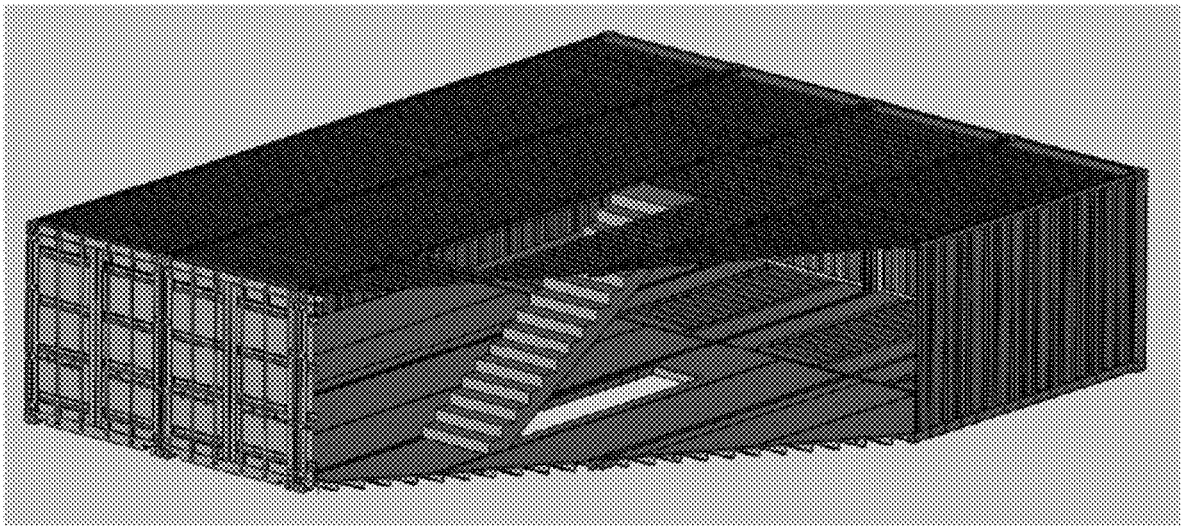
Figure 6C:
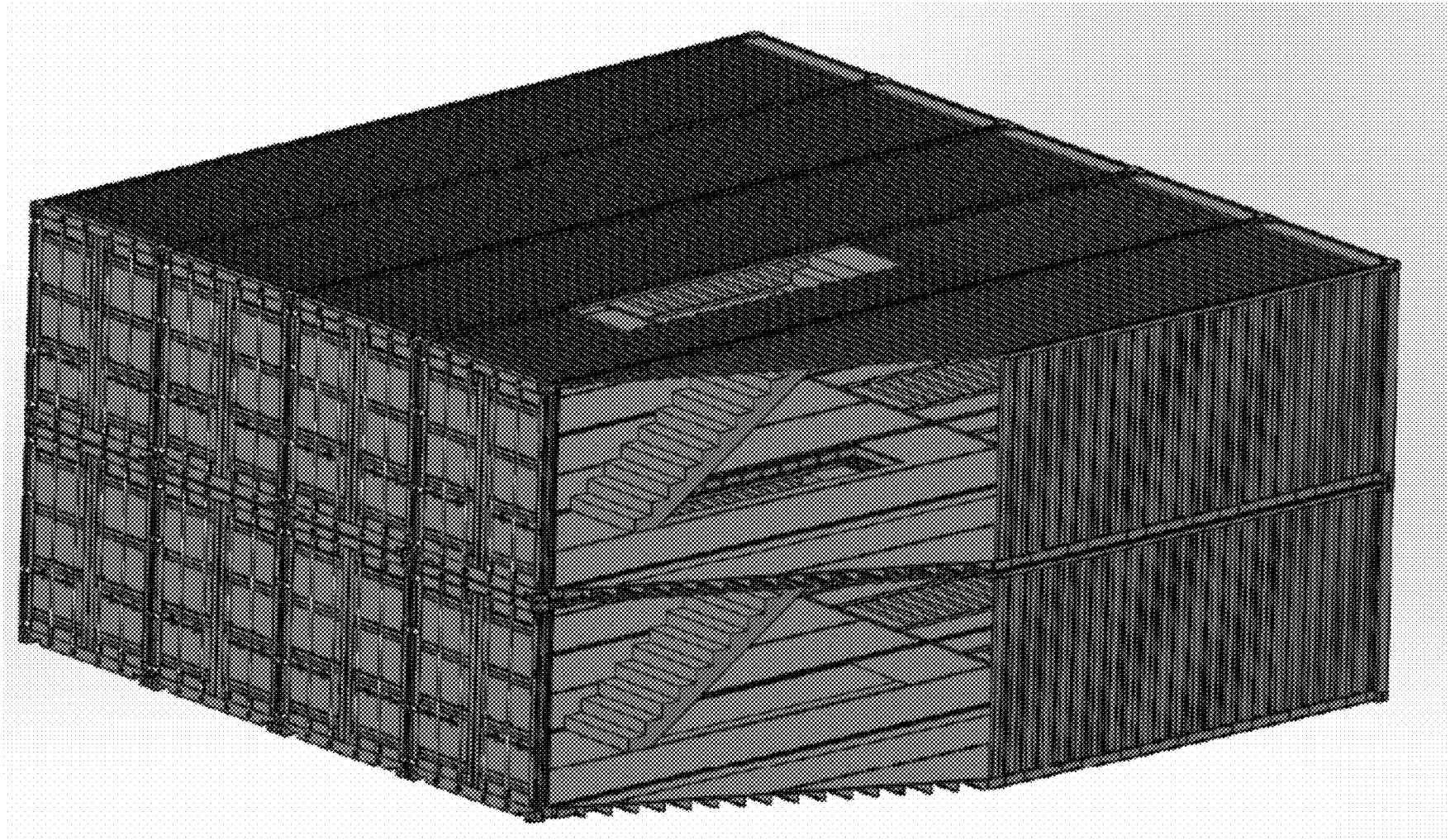

The inner door 125 is shown positioned orthogonally to a lengthwise axis of the modular structure. In some aspects, inner doors may be positioned parallel to a lengthwise axis of the modular structure. In example embodiments of modular structure systems in which two or more modular structures (such as the spacer or access modular structures of FIG. 4B-4C) are connected in a side-by-side configuration (e.g., as shown in FIGS. 6A-6C), inner doors may be positioned to separate two modular structures connected side-by-side. For example, in a situation which three modular structures are connected side-by-side, inner doors may be installed to define a "dirty volume" first modular structure, a "decontamination volume" second modular structure, and a "clean volume" third modular structure. The inner doors may separate and fluidly decouple such volumes.

Figure 9A:
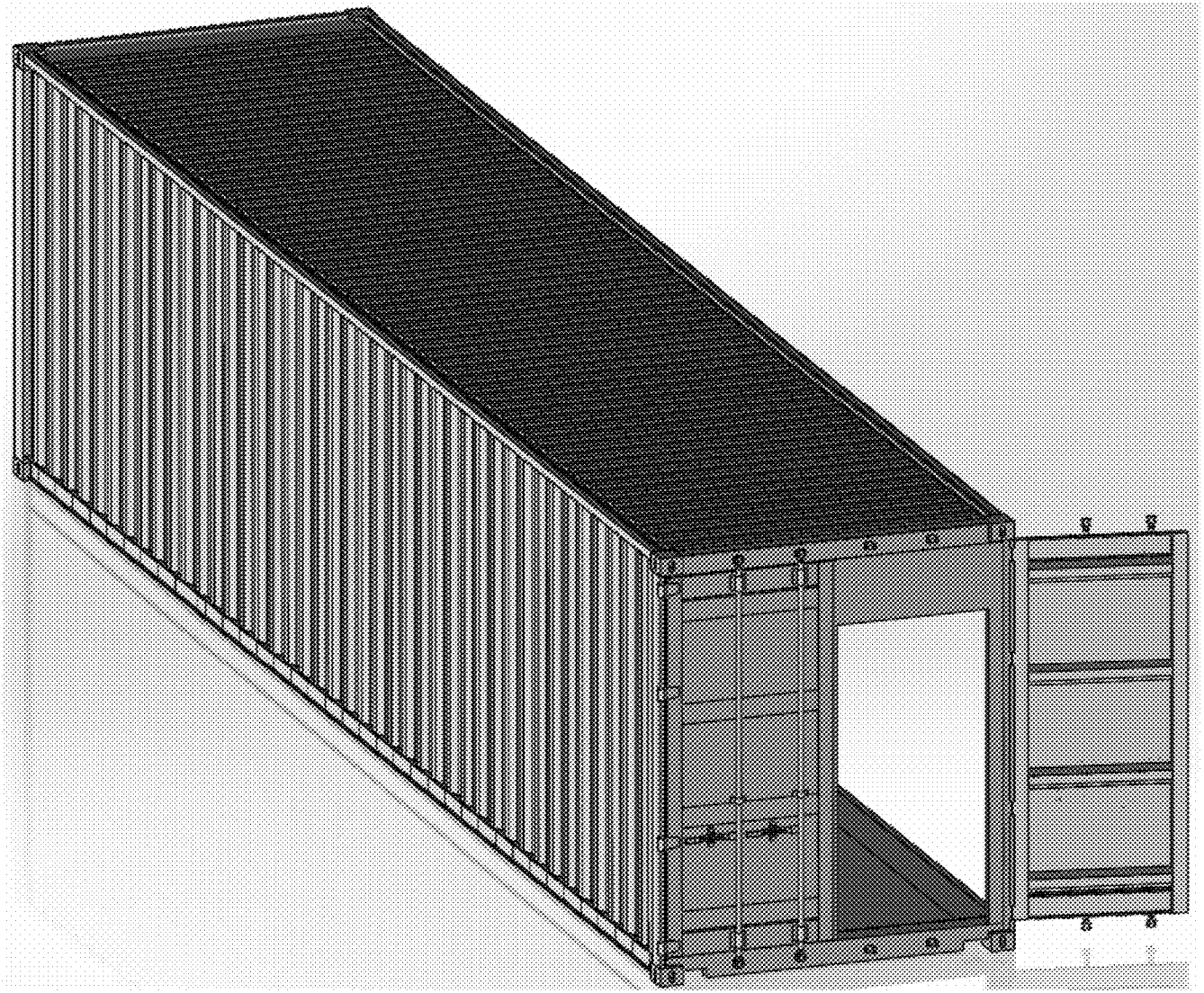
FIGS. 9A-9G are schematic illustrations of an example implementation of a modular structure that includes a door assembly that includes two or more doors.
Figure 9B:
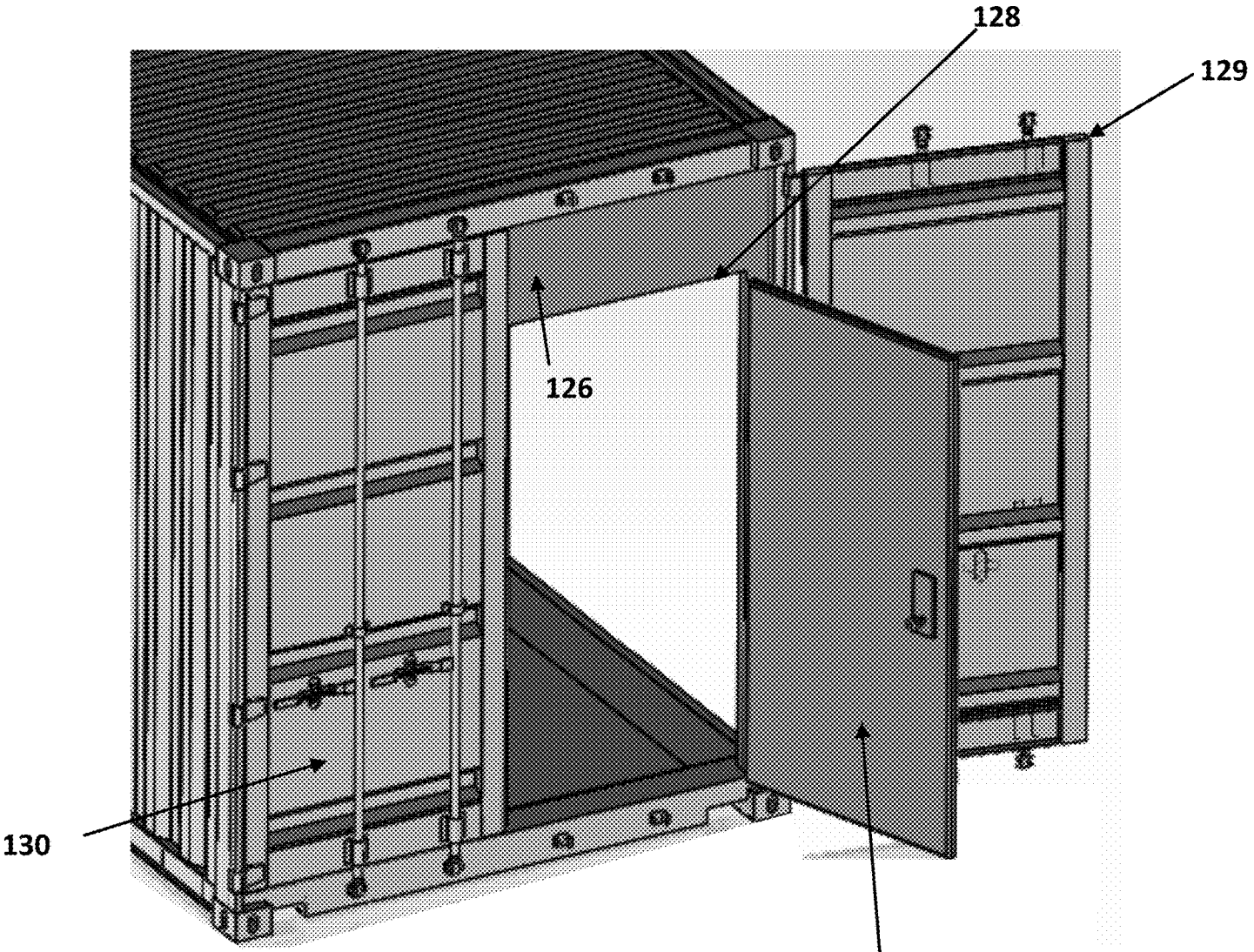
Figure 9C:
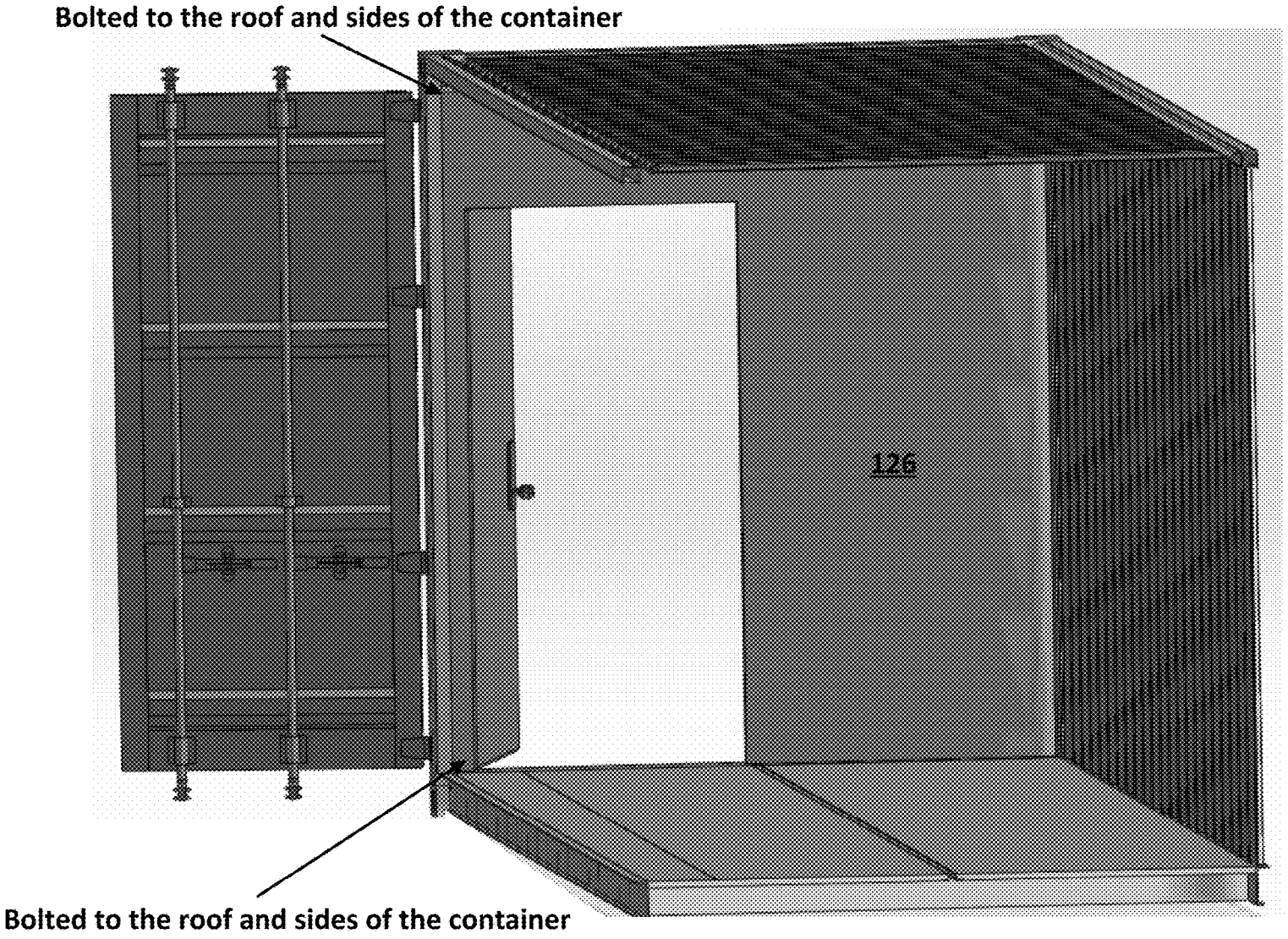

The inner door may actually be part of one of the two barn doors in order to allow for routine man door usage and then allow larger items to pass without constricting width. For example, turning to FIGS. 9A-9G, these figures illustrate an example implementation of a modular structure that includes a door assembly that includes two or more doors, with at least one of the one or more doors being an interior door and at least another of the one or more doors being an exterior door. As shown in FIGS. 9A-9B, a door assembly according to an example implementation includes a wing frame extension 126 that is mounted across an opening defined by mounting barn doors 130 and 129. As shown, the wing frame extension 126 provides a frame and opening for an interior door 127 (e.g., sized as a conventional door for human egress and ingress) that connects to the wing frame extension 126 through a hinge 128 (or multiple hinges 128). In this example, the right barn door 129 is decoupled from the wing frame extension 126, while the left barn door 130 is coupled to the wing frame extension 126. As shown in FIG. 9C, the wing frame extension 126 may be attached (e.g., bolted, welded, or otherwise) to a roof and sides of the modular structure.

In some aspects, the door assembly (e.g., combination of barn doors 129/130 and interior door 127 mounted to wing frame extension 126) allows for a human door, watertight door, airtight door, scuttle, or other access in order to allow faster and easier entry into the modular structure. Further, such an interior door 127 may allow for a watertight or airtight seal to the modular structure, which may be useful in the event of nuclear, biological, or chemical environments that could be toxic to the inhabitants of the modular structure.

Figure 9D:
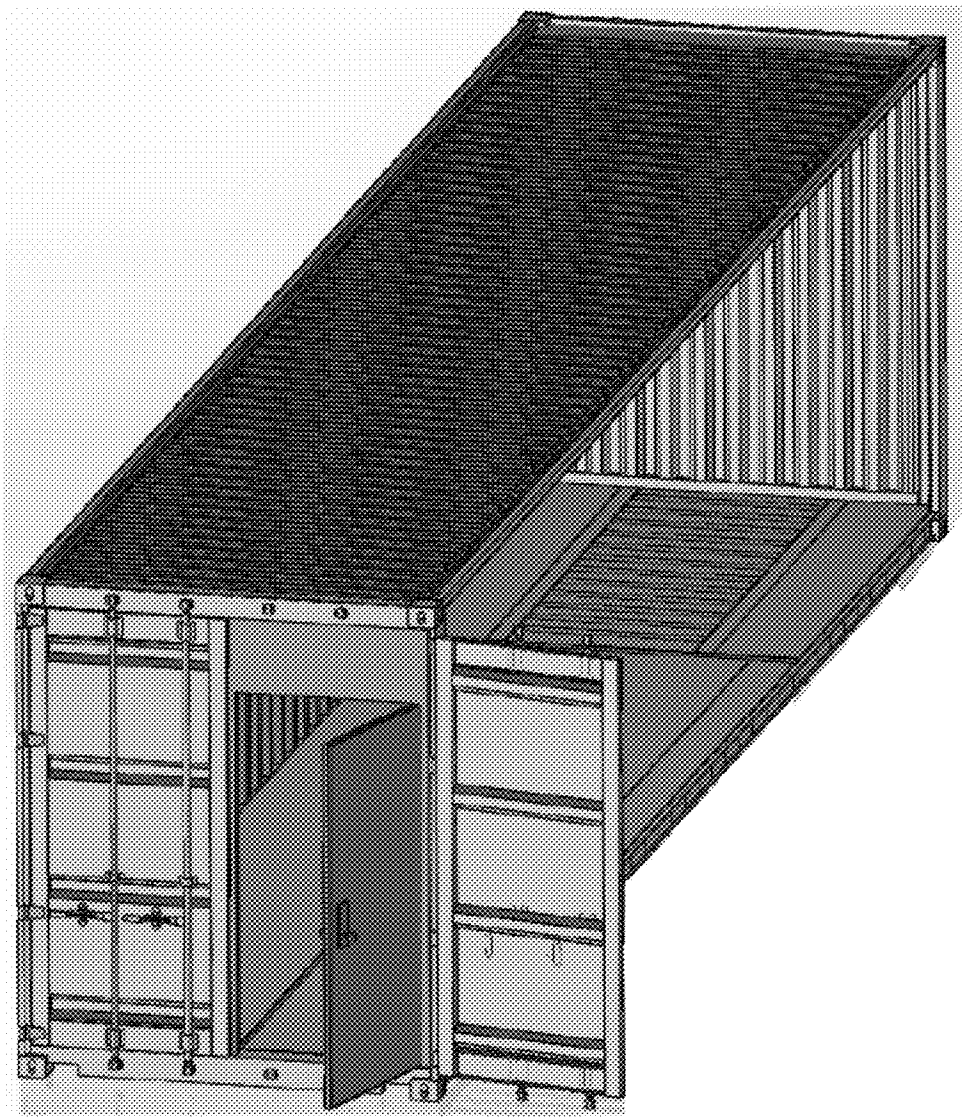

In some aspects, the illustrated wing frame extension 126 may allow users to quickly and easily access the space within the modular structure by keeping one of the barn doors open at all times (while still maintaining the ability to seal the modular structure by closing both barn doors 129/130), as shown in FIG. 9D. Without such a door assembly, in some aspects, a user may have to open and close the large barn doors 129/130 every time the user needed to gain access to the modular structure. The wing frame extension 126 can be installed on either the left or right barn door.

Figure 9E:
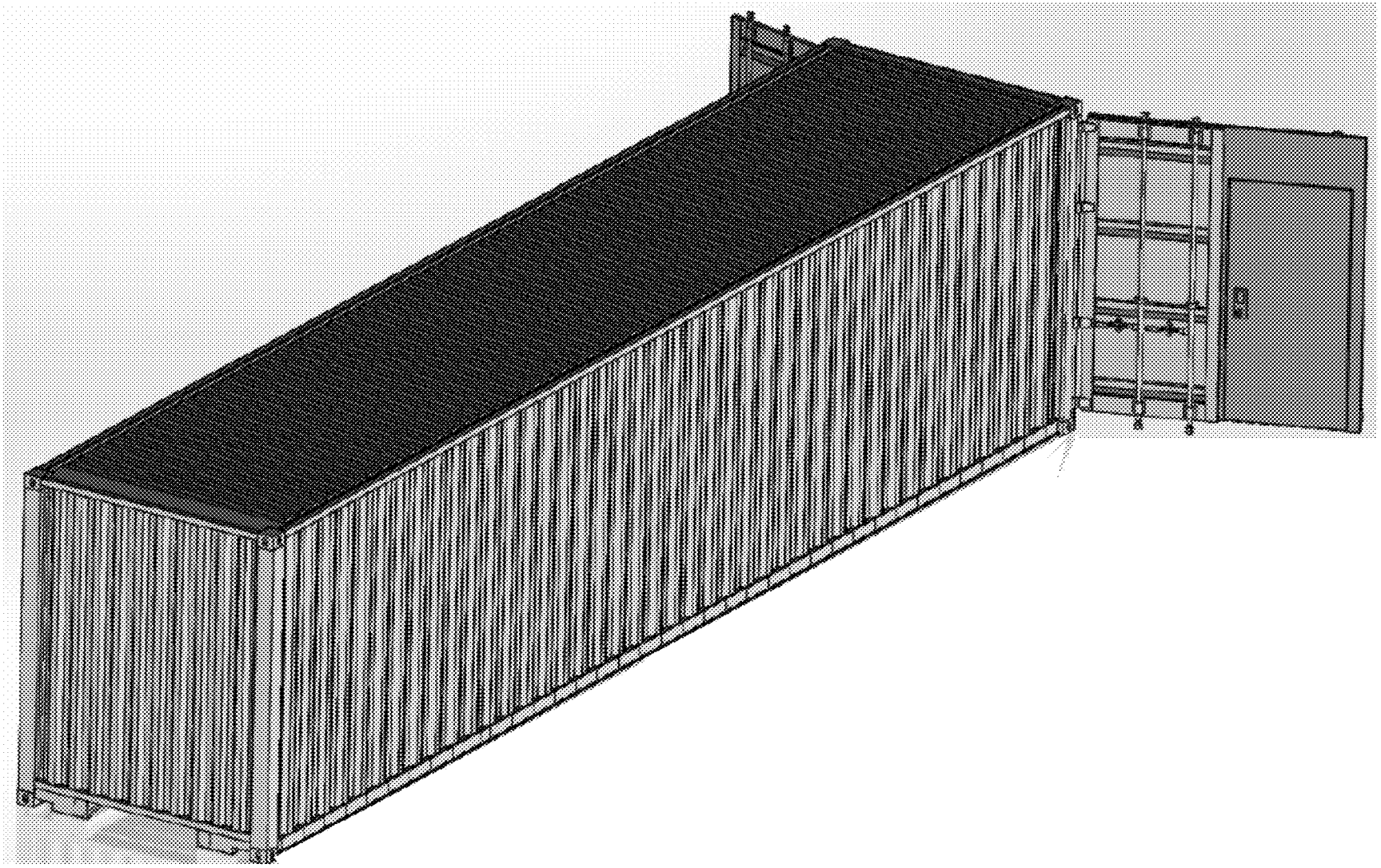
Figure 9F:
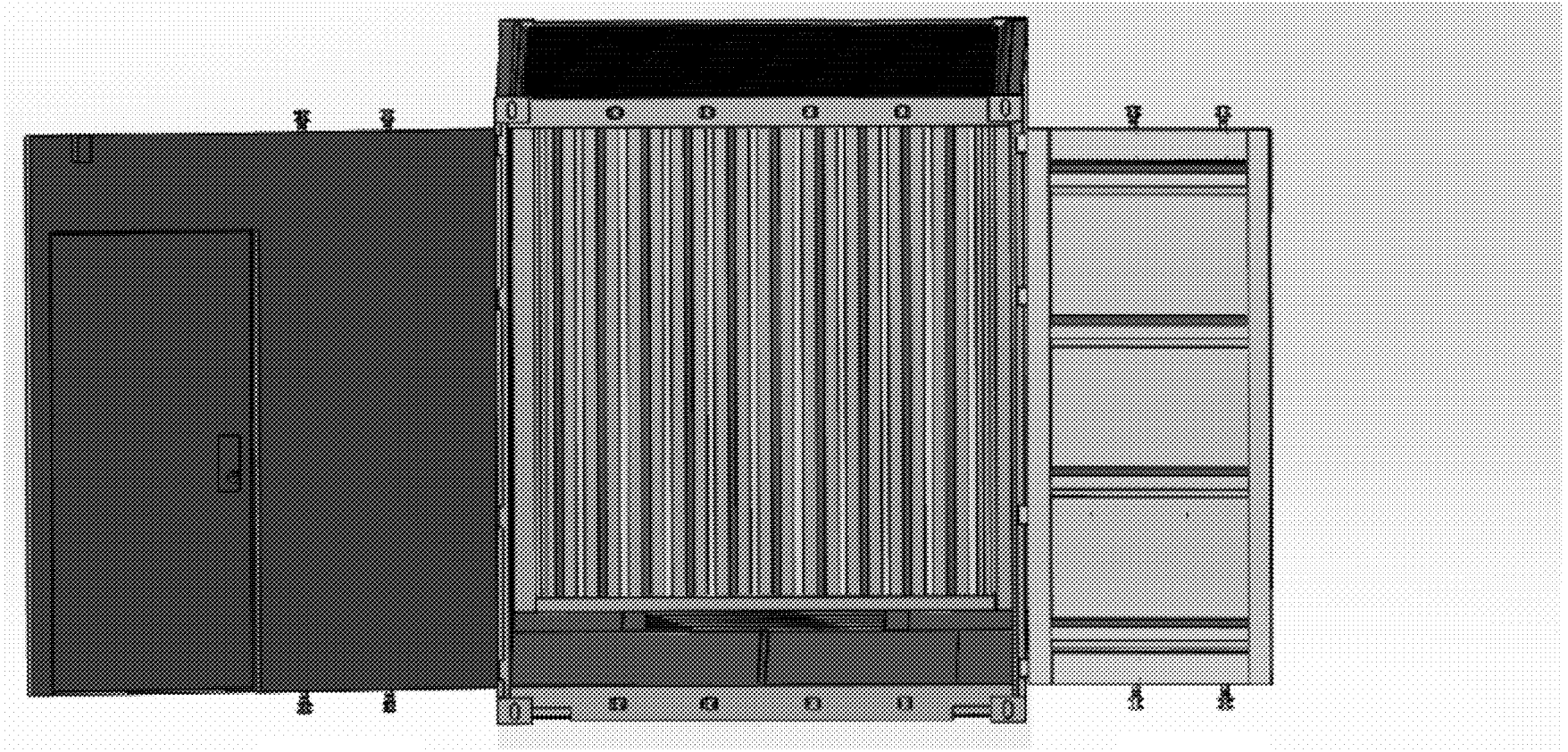
Figure 9G:
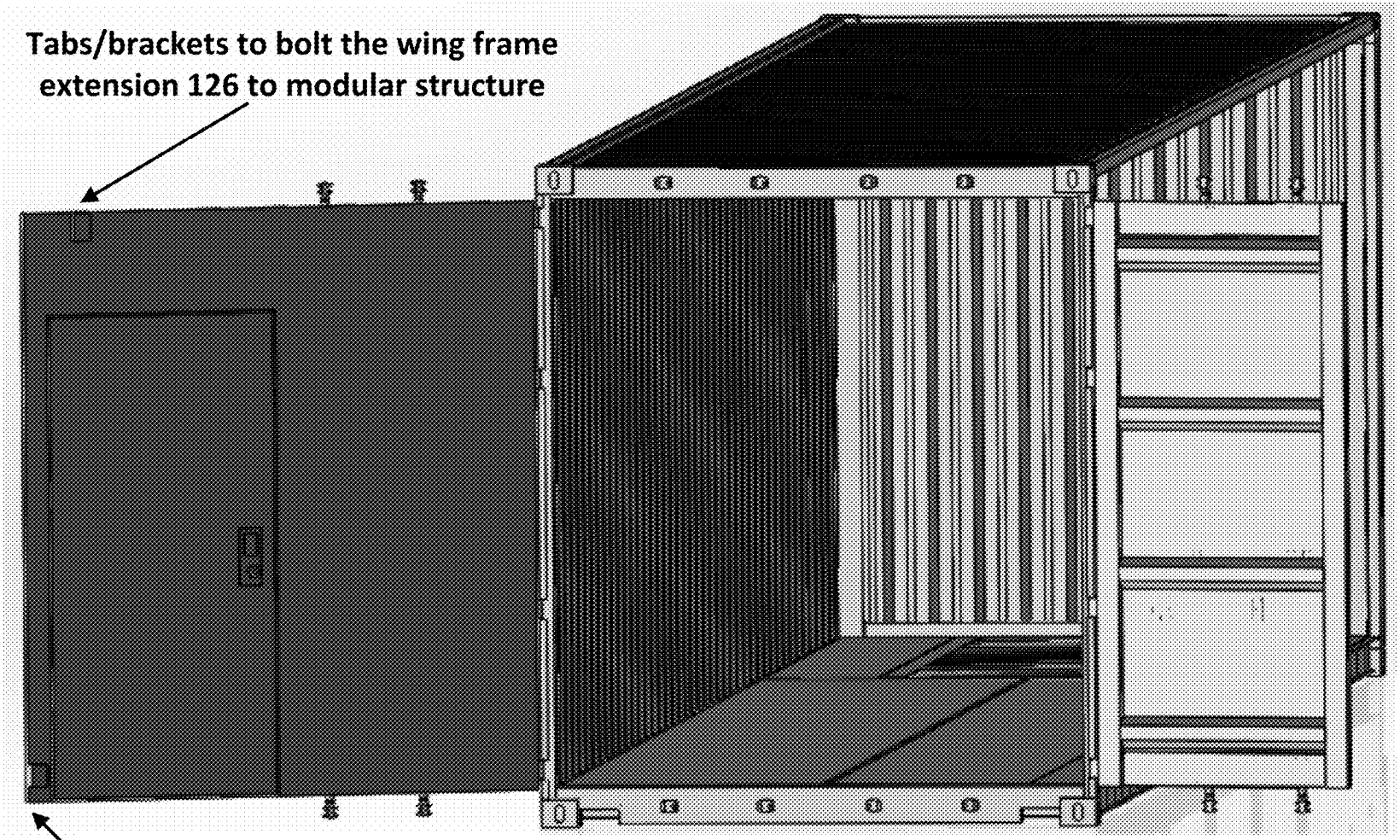

In some aspects, the interior door 127 can be outfitted with any type of locking/security access system (e.g., regular locks, cypher locks, scanners, digilocks, proximity readers, biometric readers). The interior door 127 could be manually or automatically operated. The user can then leave the right barn door 129 open (in this configuration, other configurations may have the wing frame on the right barn door, leaving the left barn door 130 open) and then access the modular structure through the interior door 127. When the door 127 is closed, the wing frame extension 126, if attached to the mounting barn door (i.e., left barn door 130) could be bolted to the closed barn door side of the modular structure in order to provide additional stability to the wing frame. For additional security, the right barn door 129 could be closed and locked without revealing the fact that the container had been modified which may be useful in shipping or during storage In some aspects, the wing frame extension 126 could be attached (e.g., welded, fastened, bolted) to either the barn door or to the modular container, as shown in FIG. 9G. In the event larger items need to be inserted into or removed from the modular structure, the wing frame extension could be unbolted from a floor of the modular structure and the mounting barn door 130 would be opened, as shown in FIGS. 9E-9G. The modular structure would then be fully accessible with no restriction in width.

In some aspects, an additional wing frame extension 126 could be installed in an interior volume of the modular container, e.g., several feet away from the wing frame extension 126 shown adjacent the barn doors 129/130. In such aspects, a decontamination area may be created and defined between the extensions 126 within the interior volume of the modular container. Thus, there may be a two-stage ingress into the container created by the wing frame extensions 126. A user would enter a decontamination volume first (e.g., between the two wing frame extensions 126) before entering a clean volume (e.g., in the container past the second, interior-mounted wing frame extension 126). Such a set of dual door assemblies may be helpful to create a decontamination zone, or toxic cleanup zone, or to create a clean-room purging, cleaning, or dressing area. Depending on the desired use, additional stages may be added and/or different containers may be used to create separate areas that could be used not just for decontamination but also for other purposes.

For example, multiple, separated and isolated areas within one or more modular structures that are coupled together may ensure a higher level of cleanliness required for certain applications (e.g., silicon wafer design with separate compartments (8) required for a 1/100,000 pp, clean room that require: initial entrance, dirty changing compartment, shower compartment, drying compartment, clean dressing room, SCBA/PPE outfitting room, testing chamber, entrance to clean area.)

As another example, multiple, separated and isolated areas within one or more modular structures that are coupled together may create an environment for a desired end use (e.g., decompression, fumigation, imbuing a material with a chemical gas at an elevated temperature like titanium nitride coatings). These additional compartments could be spaces with different temperatures, pressures, in a vacuum, or pressured (filled) up with different gases. This could be for spraying consumables, humanely killing livestock, scientific applications that require different temperatures or pressures but still require a human to enter. In short, these partitions function as a quick acting watertight door such as in a space station.

In some aspects, a parent modular structure may be a base building block and can be configured for SCIF (Sensitive Compartmented Information Facility) or NBC (Nuclear, Biological, and Chemical) Treatment and Resistant Facility variants by modifying the inner door space and ventilation and access systems. In some aspects, a parent modular structure can handle incoming and outgoing power. In some aspects, a parent modular structure (or also an "all-in-one" unit) can also be used as a base for a "solar hub" or "power units" which is to say, solar, wind, turbine, generator, (or other source of power) with or without energy storage. The generated power may then be distributed from the parent modular structure to child modular structures or to a public power grid (if connected to the grid) or used within a parent container.

FIGS. 4A-4C are isometric, open views of another modular structure according to implementations of the present disclosure. FIG. 4A, for example, may represent a child modular structure. In some aspects, the child modular structure shown in FIG. 4A may be a mirror image to a parent modular structure shown in FIG. 3 but without the HVAC module or Power/Network module. In some aspects, a child modular structure may also not include an interior door 125. Thus, in some aspects, the child modular structure may be used with (e.g., connected to) another modular structure, such as the parent modular structure, in order to receive cooling/heating, power, and network connectivity.

FIG. 4B shows an example implementation of a spacer modular structure. For example, as shown in FIG. 4B, a spacer modular structure is missing sides A and B (105 and 106, respectively). In some aspects, the spacer modular structure shown in FIG. 4B may be used to create additional space between two modular structures (e.g., a parent modular structure and a child modular structure) or to create a sheltered awning. The spacer modular structure shown in FIG. 4B may provide additional width and length while providing protection overhead and a solid floor. Such spacer modular structures may also provide protection at the ends and/or access at a door (or solid) end of a modular structure. Spacer modular structures may also provide conduits for utility connections while expanding the area of a modular structure system of more than one modular structures.

FIG. 4C is an example access modular structure. As shown, the riser modular structure does not include the top 107, the bottom 108, or the sides 105 and 106. In some aspects, a riser modular structure may be used in a modular structure system of two or more modular structures to connect structures, such as child, parent, or spacer structures to create a larger (and "two-story") volume. In some aspects, a riser modular structure may accommodate one or more stairwells that connect two or more modular structures within a system.

In some aspects, as shown, the modular structures shown in FIGS. 4A-4C (and 5) may include at least one side of the structure which has been removed. In some aspects, the open area left by the removed side may allow for ingress and egress between connected modular structures. In some aspects, one or more inner doors may be installed in partially open areas left by the partial removal of a side of the modular structure. In some aspects, another solid material, such as a clear or opaque material (glass, acrylic) may be installed in place of the conventional metal corrugated panel of the modular structure. For example, in aspects where a spacer or access or riser modular structure is positioned along a perimeter of a modular structure system, glass may be positioned in the open areas to provide light ingress into the modular structure system.

Figure 5:
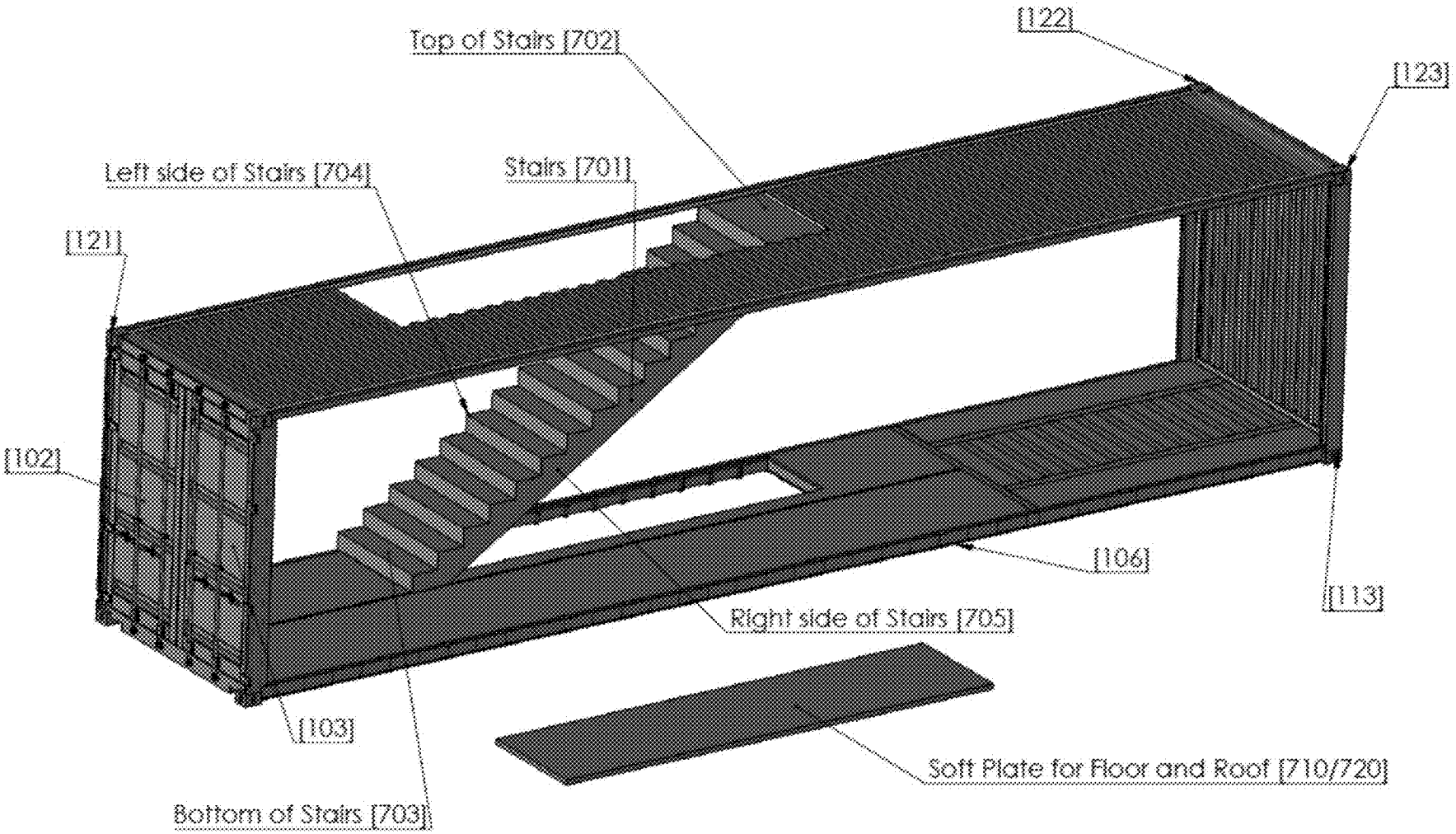
FIG. 5 is a partially exploded view of another modular structure according to implementations of the present disclosure.

FIG. 5 is a partially exploded view of another modular structure according to implementations of the present disclosure. FIG. 5 shows a particular riser modular structure in which a stairwell (or stairs) 701 is provided. As shown, one or more soft plates (710 for the bottom 108 and 720 for the top 107) may be removed or removable from the riser modular structure. Bottom 703 of the stairs 701 is mounted to the bottom 108 adjacent a hole made by the removal of the soft plate 710. Top 702 of the stairs 701 is mounted to the top 107 adjacent a hole made by the removal of the soft plate 720. Left side 704 and right side 705 of the stairs 701 are shown in this figure and may include railings. In some aspects, the soft plates 710 and/or 720 may be put back into place (one or the other or both).

In some aspects, in a modular structure system, one or more riser (or child) modular structures can be placed orthogonally across an end of multiple modular structures positioned and connected side-by-side. The riser modular structures may include components such as HVAC and power components and provide a "mechanical" space that stretches across at least a portion of the side-by-side modular structures. In some aspects, ingress/egress structures (e.g., doors) may be provided from the riser modular structure spaces into ends of one or more of the side-by-side modular structures (such as the side-by-side modular structures shown in FIGS. 6A-6C).

In some aspects, the modular structures shown in FIGS. 4A-4C and 5, when incorporated into a multi-modular structure system (such as is shown in FIGS. 6A-6C and 7A-7B) may also include apertures (or may be modified to include apertures) through which an elevator shaft may be formed. An elevator or "dumbwaiter" may be installed to move through the elevator shaft so that equipment, persons, and other items may be moved between floors of a multi-floor modular structure system (e.g., a system with at least two container stacked vertically). In some aspects, a traditional electric or hydraulic elevator system may be used to move the elevator. Alternatively, a forklift machine (mounted in a bottom container within a stack of containers) or a crane machine (mounted in or on top of a top container within a stack of containers) may be used to move the elevator between floors. Alternatively, a forklift machine or crane may be used in place of an elevator to move cargo or other items between floors.

FIGS. 6A-6C are isometric views of example implementations of modular structure systems according to the present disclosure. For example, FIG. 6A shows an example single level modular structure system in which, for example, a combination of two modular structures are connected together to form a single modular structure system with a single, integrated interior volume. The example modular structure system of FIG. 6A may be, for example, a parent modular structure connected to a child modular structure.

FIG. 6B shows an example single level modular structure system in which, for example, a combination of four modular structures are connected together to form a single modular structure system with a single, integrated interior volume. The example modular structure system of FIG. 6B may be, for example, a parent modular structure connected to a spacer modular structure connected to a riser modular structure connected to a child modular structure.

FIG. 6C shows an example two level modular structure system in which, for example, a combination of five modular structures in each level are connected together to form a single modular structure system with a single, integrated interior volume. Each level of the example modular structure system of FIG. 6C may be, for example, a parent modular structure connected to two spacer modular structures connected to a riser modular structure connected to a child modular structure. The two levels are also connected together, with the riser modular structures providing access between the two levels.

Figure 7A:
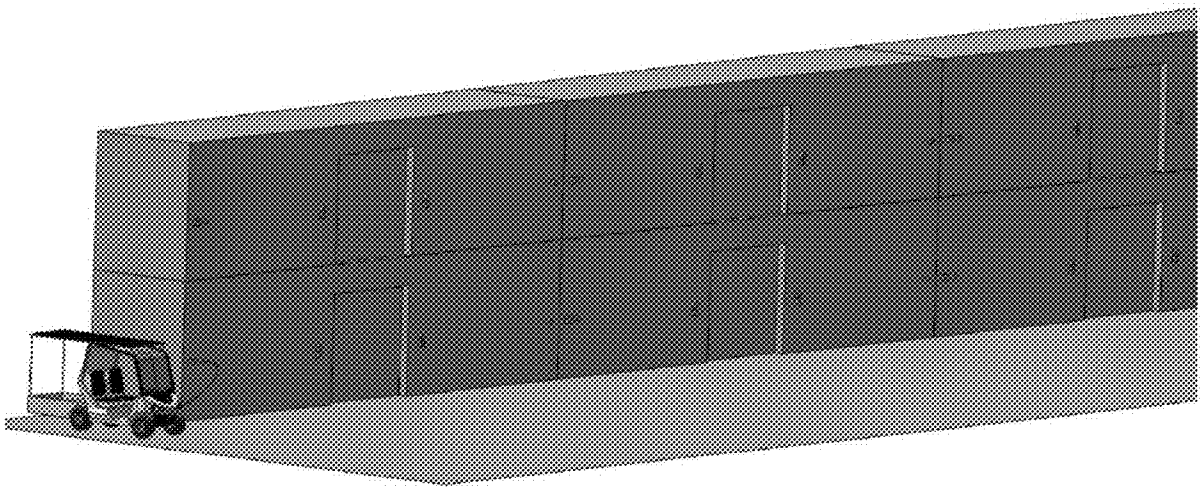
FIGS. 7A-7B are example implementations of modular structure systems with one or more appurtenances according to the present disclosure.
Figure 7B:
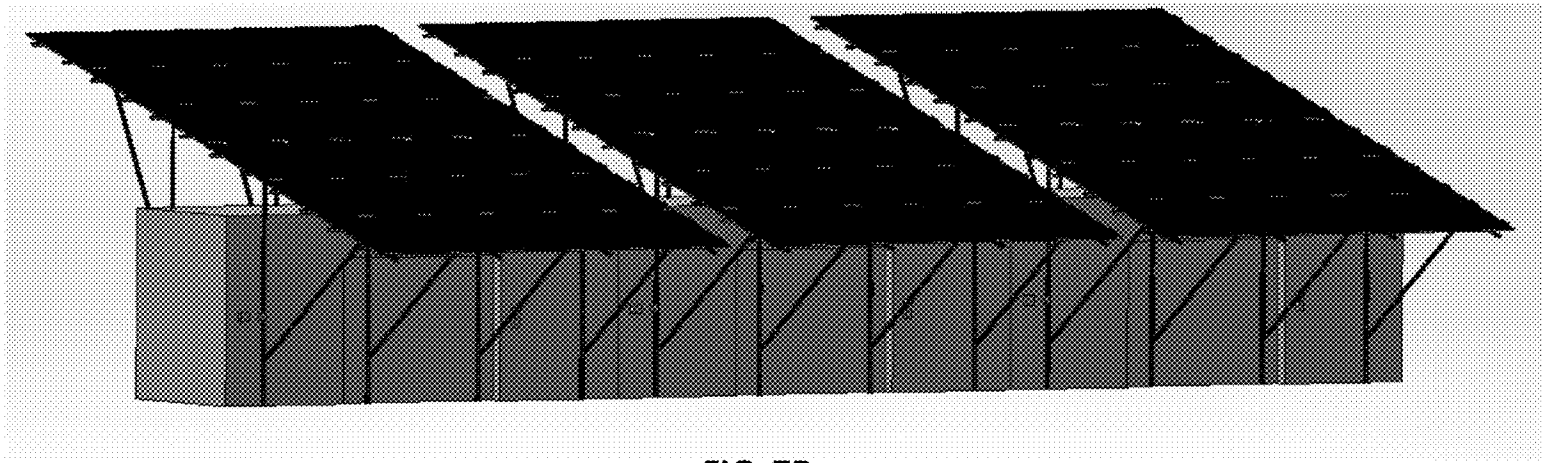

FIGS. 7A-7B are example implementations of modular structure systems with one or more appurtenances according to the present disclosure. For example, FIG. 7A shows a two level, single row modular structure system. One or more of the modular structures may include power connections (electrical or otherwise) provided on an exterior portion of the modular structure system in order to, e.g., provide power to a work or personal vehicle as illustrated. In some aspects, alternatively, there are some embodiments of the modular structures that may not have any power outlets mounted externally, as they may be energy independent or may not have any outward modifications to not give away the intended use . . . . FIG. 7B shows multiple solar power assemblies (e.g., photovoltaic cells) mounted on a modular structure system. The solar power assemblies may be connected (e.g., to a parent modular structure) to provide electric power to a modular structure system.

Figure 8B:
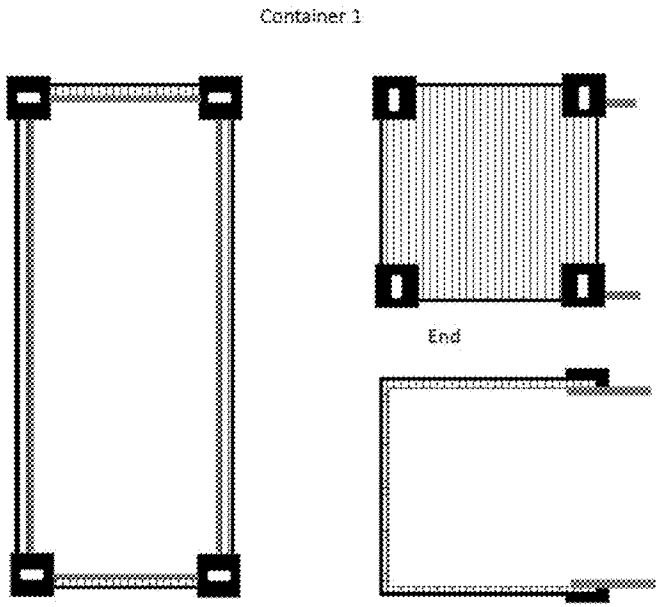
FIGS. 8A-8K are schematic illustrations of one or more fastening assemblies and techniques for connecting modular structures according to the present disclosure.
Figure 8A:
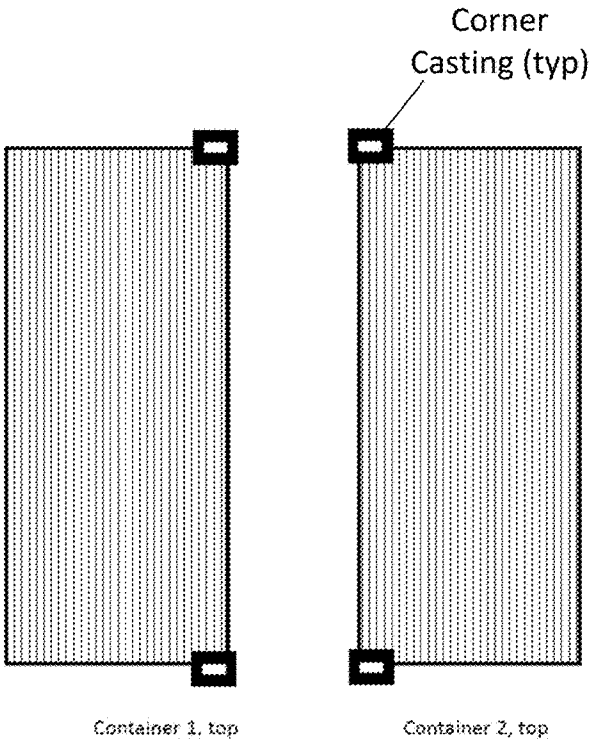

FIGS. 8A-8K are schematic illustrations of one or more fastening assemblies and techniques for connecting modular structures according to the present disclosure. For example, turning to FIG. 8A, this figure illustrates how two modular structures can be connected at their respective sides. This figures illustrates a top view of two modular structures (e.g., ISO shipping containers, or "containers") labeled Container 1 and Container 2 that can be joined at respective open sides to create a modular structure system. FIG. 8B shows side and end views of how the Container 1 and Container 2 can come together to be connected to form the modular structure system.

Figure 8C:
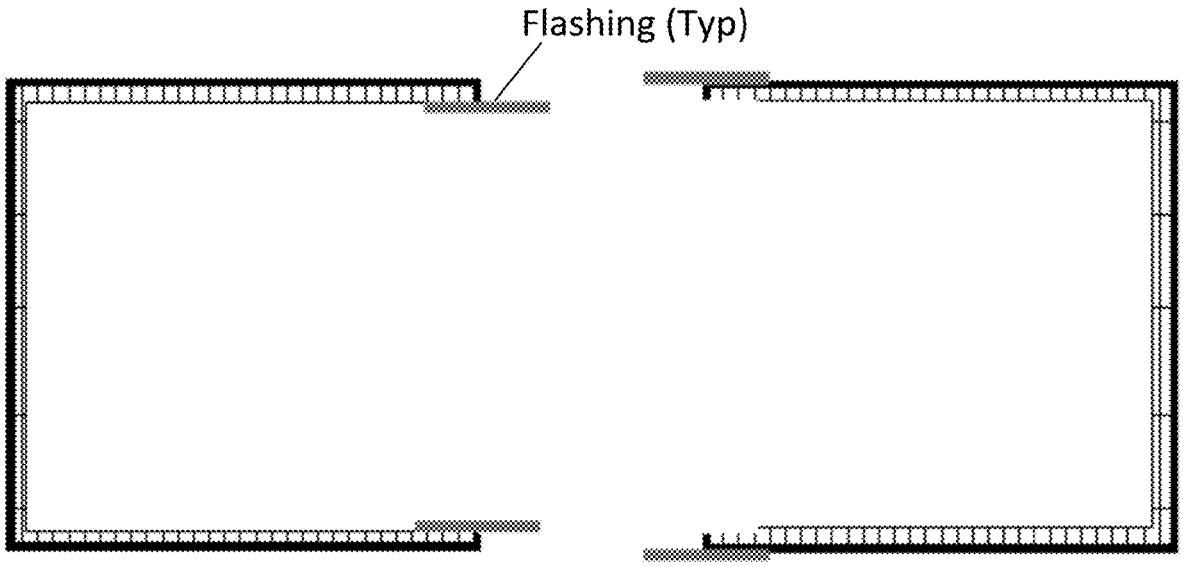
Figure 8D:
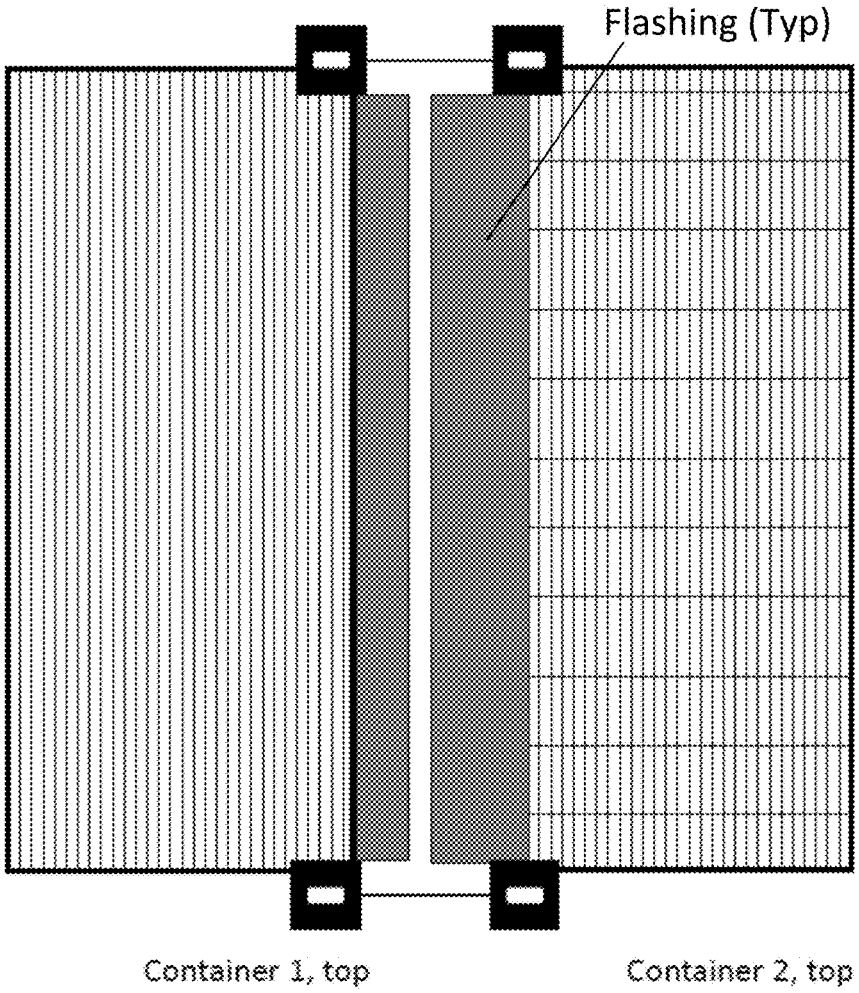

FIG. 8C shows an end view of the Container 1 (on the left) and Container 2 (on the right) as they are brought together to be joined. FIG. 8D shows a top view of the Container 1 (on the left) and Container 2 (on the right) as they are brought together to be joined. As shown, each container has an open side that face each other as the containers are brought together. Flashings (e.g., of aluminum, steel, carbon fiber, fiberglass, or other rigid or semi-rigid material) may be coupled to each container as shown, e.g., an interior surfaces of Container 1 and exterior surfaces of Container 2. Each flashing may provide a fluid seal (e.g., against water or other liquid or ambient air) against fluid intrusion into an inner volume of the modular structure system created by joining Container 1 and Container 2.

Figure 8E:
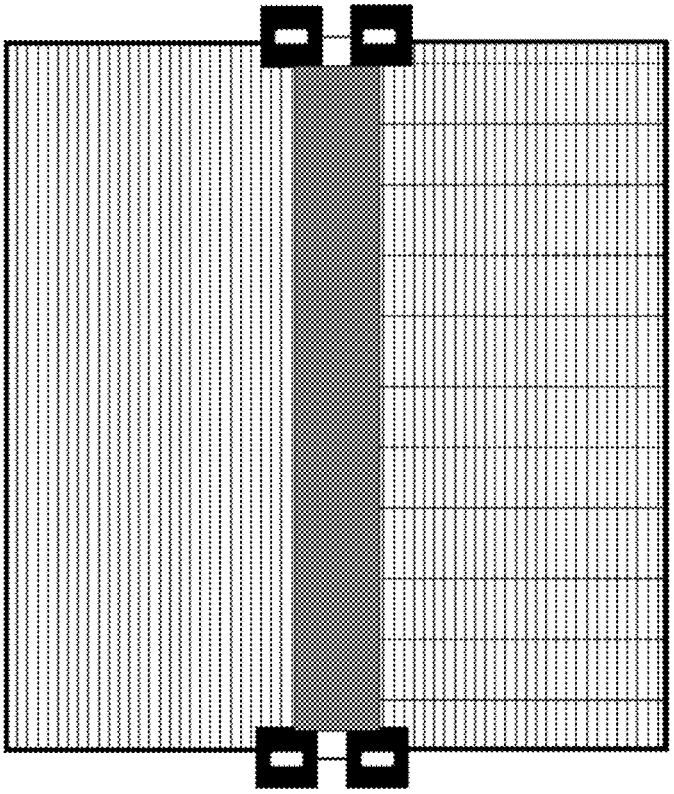
Figure 8F:
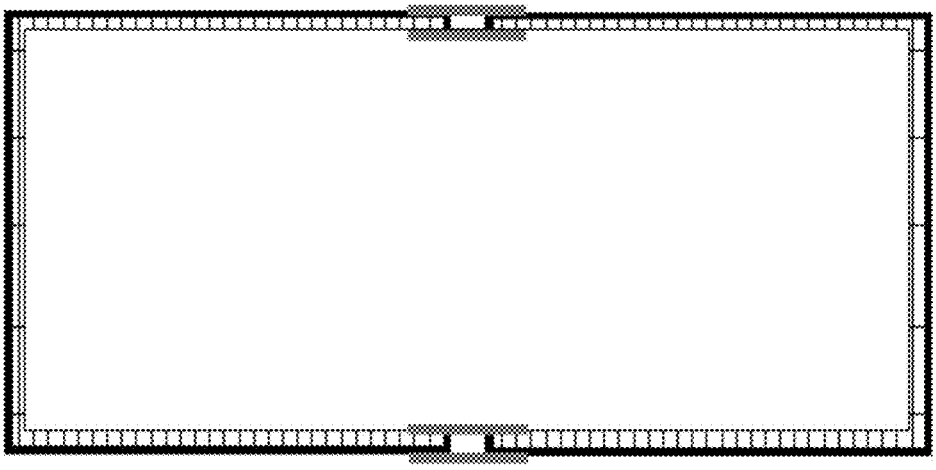

FIGS. 8E and 8F show top and end views, respectively, of Container 1 (on the left) and Container 2 (on the right) as they are joined to form a modular structure system. As shown, the respective flashings on each container, when the containers are joined, overlap to provide the fluid seal. Each flashing may be fastened (e.g., by a mechanical faster, welding, brazing, soldering, or otherwise) to each container when joined.

Figure 8G:
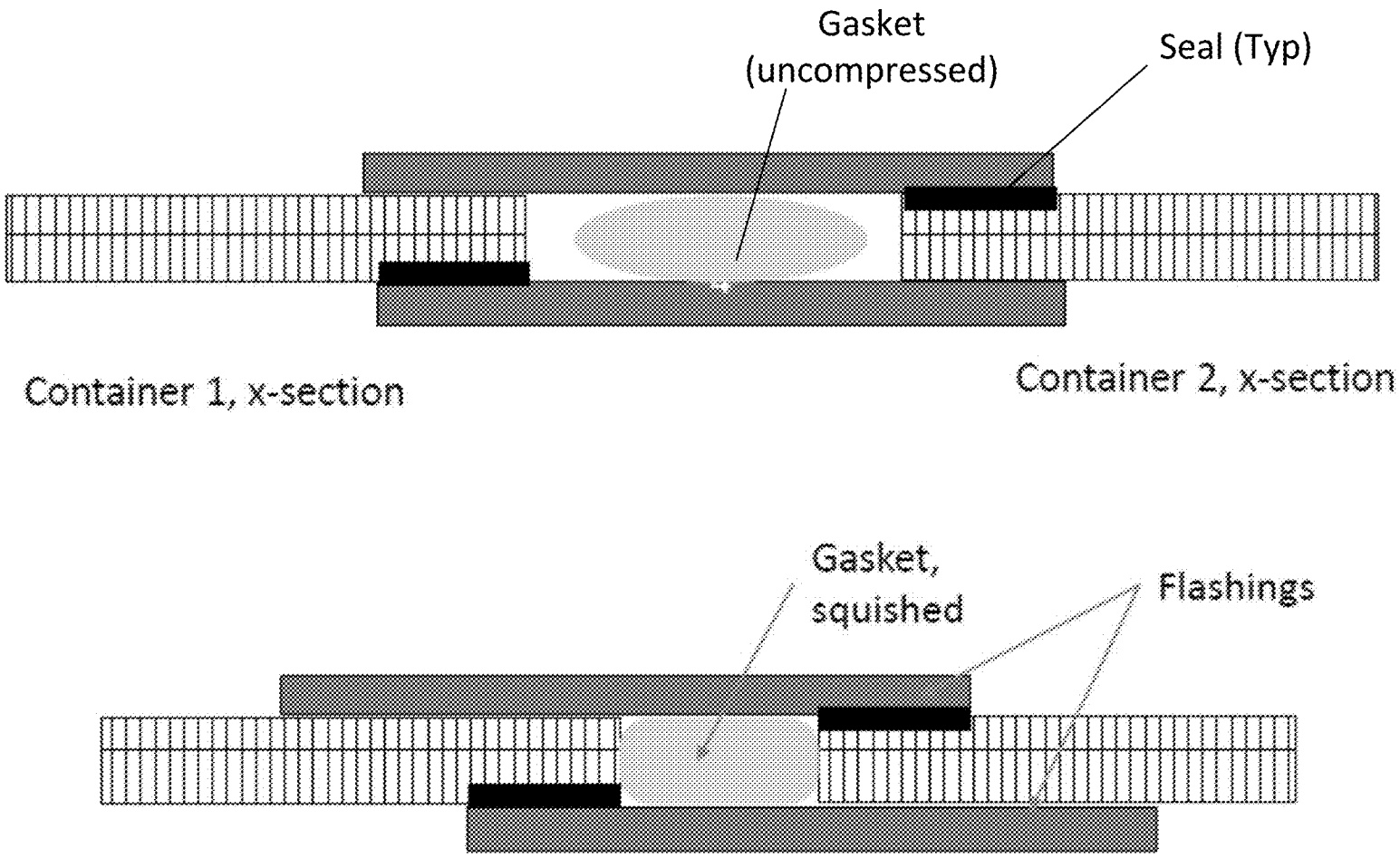

FIG. 8G shows a detail of the connection of Container 1 and Container 2 as the containers are brought together to be joined (top illustration) and eventually joined (bottom illustration). For example, as shown, a pliable gasket material (e.g., silicon, rubber) may be positioned between the edges of the containers as the flashings overlap the respective containers. Prior to final connection of Container 1 and Container 2, the gasket may be uncompressed as shown in the top illustration. Once the Container 1 and Container 2 are finally joined, the gasket is compressed or squished to fill up a space between the containers. As shown in these (and other) figures, a seal (another pliable material) may be positioned (e.g., and attached) between respective flashings and surfaces of the containers.

Figure 8H:
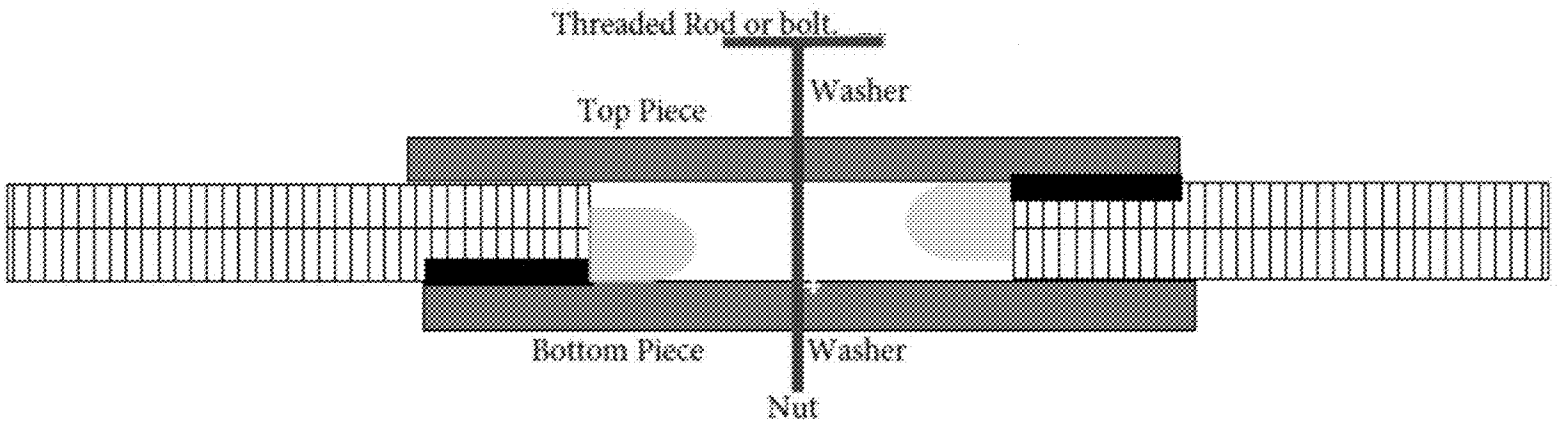
Figure 8I:
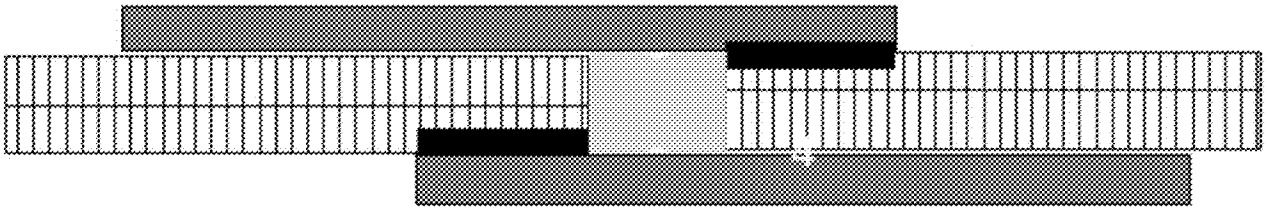

FIG. 8H shows an example implementation in which two gasket materials are provided (e.g., one attached to each edge of an open side of one of the containers). As shown in FIG. 8I, once Container 1 and Container 2 are joined fully, the two gasket materials are pushed together to provide the fluid seal. As further shown in FIG. 8H, a fastening system (e.g., shown as a threaded bolt or rod, a washer, and a nut) may be provided to attach respective flashings once the containers are connected. For example, once connected, a bolt or threaded rod may be inserted through both flashings. One or more washers may be inserted onto the rod and adjacent one or both of the flashings. The nut may be threaded onto the rod to secure the washers to the rod and, therefore, secure the two flashings together.

Figure 8J:
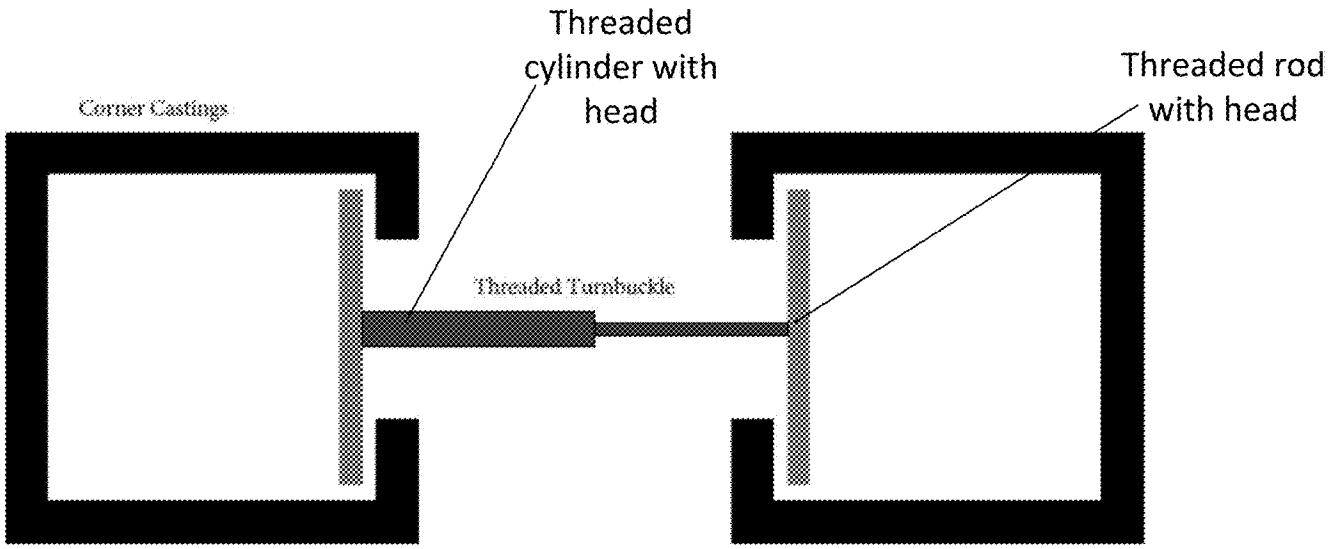
Figure 8K:
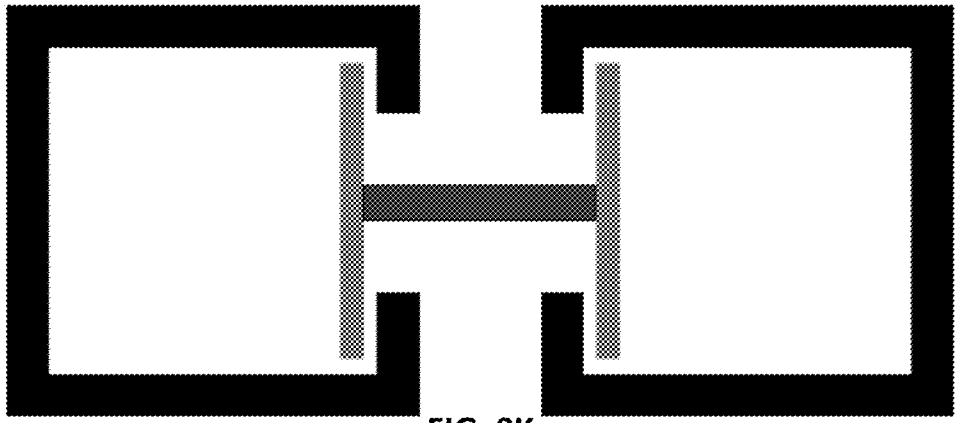

FIGS. 8J-8K show an example of another connection assembly that may be used in place of or in addition to the flashings shown in the previous figures. For example, as shown in FIG. 8J, a threaded turnbuckle may include a threaded rod with head (shown on right) that can be threadingly attached to a threaded cylinder with head (shown on left). The respective heads of the threaded turnbuckle can be securably inserted into respective corner castings of two containers. Then, as shown in FIG. 8K, the threaded rod can be threaded into the threaded cylinder in order to shorten the threaded turnbuckle and bring the respective corner castings (and containers) together.

Particular embodiments of the subject matter have been described. Other embodiments are within the scope of the following claims. For example, the actions recited in certain claims can be performed in a different order and still achieve desirable results. As one example, the processes depicted in the accompanying figures do not necessarily require the particular order shown, or sequential order, to achieve desirable results.

What is claimed is:

1. A modular structure, comprising:

a first shipping container comprising:

an inner cavity, an open side with four corners, each a corner comprising corner casting, and an inner flashing secured around an inner periphery of the open side, the inner flashing extending away from the open side;

a second shipping container positioned adjacent to the first shipping container, the second shipping comprising:

an inner cavity, and an open side with four corners, each corner comprising a corner casting, the open side of the second shipping container arranged opposite to the open side of the first shipping container; and an enclosure defined by the inner cavities of the first and second shipping containers and the inner flashing, wherein each of the four corner castings of the first shipping container is located opposite and adjacent to a respective one of the four corner castings of the second shipping container, and the open sides of the first and second shipping containers define a peripheral gap therebetween, the peripheral gap being covered in the enclosure by the inner flashing.

2. The modular structure of claim 1, further comprising at least one fastener that secures a corner casting of the first shipping container to a respective corner casting of the second shipping container, the fastener arranged to define a width of the peripheral gap.

3. The modular structure of claim 2, wherein the fastener is an adjustable fastener operable to adjust the width of the peripheral gap.

4. The modular structure of claim 1, wherein the open side of the second shipping container comprises an outer flashing secured around an outer periphery of the open side, the outer flashing extending away from the open side, the outer flashing covers an exterior portion of the peripheral gap, and defines a portion of an exterior surface of the modular structure.

5. The modular structure of claim 4, wherein the inner flashing and the outer flashing define a gasket region therebetween, and a volume of the gasket region is defined by a width of the peripheral gap, the modular structure comprising a gasket material disposed in the gasket region for sealing the enclosure of the modular structure.

6. The modular structure of claim 4, wherein the inner flashing and the outer flashing extend in parallel directions, wherein the inner flashing extends into the opening of the second shipping container, and wherein the outer flashing extends around an outer periphery of the first shipping container.

7. The modular structure of claim 4, wherein one of the first and second shipping containers comprises an external outlet configured to provide a utility connection to the modular structure.

8. The modular structure of claim 4, further comprising:

a third shipping container comprising an inner cavity, and an open side with four corners, each corner of the four corners comprising a corner casting, wherein:

the open side of the first shipping container is a first open side, first shipping container further comprises a second open side opposite the first open side, the open side of the third shipping container is arranged opposite to the second open side of the first shipping container, and the inner flashing is a first inner flashing, and a second inner flashing is secured around an inner periphery of the open side of the third shipping container or around the inner periphery of the second open side of the first shipping container, the second inner flashing covers a peripheral gap between the first and third shipping containers such that the enclosure of the modular structure is defined by the inner cavities of the first, second, and third shipping containers and the first and second inner flashings.

9. The modular structure of claim 1, wherein at least one of the first or second shipping containers comprises:

a set of sealable barn doors mounted on the open side to enclose the inner cavity; and an interior door assembly mounted within the inner cavity to partition the inner cavity into a first volume and a second volume.

10. The modular structure of claim 9, wherein the first volume comprises a contaminated area between the set of sealable barn doors and the interior door assembly, and the second volume comprises a decontaminated area between the interior door assembly and a closed side of the inner cavity opposite the open side.

11. The modular structure of claim 9, wherein the interior door assembly comprises a wing frame assembly attached to a frame of the set of sealable barn doors and an interior door mounted to the wing frame assembly.

12. The modular structure of claim 11, wherein the interior door assembly comprises a first interior door assembly, and the at least one of the first or second shipping containers further comprises:

a second interior door assembly mounted within the inner cavity to partition the inner cavity into the first volume, the second volume, and a third volume, where the first volume comprises the contaminated area between the set of sealable barn doors and the first interior door assembly, the second volume comprises the decontaminated area between the first interior door assembly and the second interior door assembly, and the third volume comprises a clean area between the second interior door assembly and the closed side of the inner cavity opposite the open side.

13. A modular structure system comprising:

a plurality of shipping containers arranged to form a contiguous enclosure comprising an interior volume of the plurality of shipping containers, wherein each of the plurality of shipping containers comprises a first side defining an opening configured to be arranged opposite and adjacent to a corresponding opening in a first side of a different shipping container of the plurality to form the contiguous enclosure;

a bottom group of the plurality of shipping containers comprising bottom sides having floor sections arranged to form a bottom floor of the modular structure;

a top group of the plurality of shipping containers comprising top sides having ceiling sections arranged to form a top ceiling of the modular structure; and a side group of the plurality of shipping containers comprising a second side having a side wall arranged to form exterior right and left side walls of the modular structure, wherein one or more shipping containers comprises an exterior outlet configured to provide a utility connection to the modular structure.

14. The modular structure system of claim 13, wherein the modular structure defines an exterior surface comprising the walls of the plurality of shipping containers facing the exterior of the modular structure, and wherein the walls of the plurality of shipping containers forming the exterior surface comprise an insulating material disposed on an inner surface of the walls.

15. The modular structure system of claim 13, wherein the plurality of shipping containers are configured to be arranged and secure longitudinally adjacent to each other.

16. The modular structure system of claim 15, wherein each shipping container comprises eight corners comprising corner casting, and wherein each shipping container is secured to one or more adjacent shipping containers by fasteners, wherein each fastener secures a corner of each shipping container to an adjacent and opposite corner of one of the one or more adjacent shipping containers.

17. The modular structure system of claim 13, wherein an interior group of the plurality of shipping containers comprises a second side with an opening opposite the opening of the first side.

18. The modular structure system of claim 13, wherein the openings in the first sides span the entire first sides.

19. The modular structure system of claim 13, further comprising:

a staircase spanning from the bottom floor toward the top ceiling and to or through a removable portion of at least one shipping container of the bottom group of the plurality of shipping containers that forms an opening, wherein the removable portion is sized and shaped to enable a user to walk up the staircase and though the opening when the removable portion is absent.

20. The modular structure system of claim 19, wherein the staircase comprises railings.

21. A modular structure system comprising:

a plurality of shipping containers arranged to form a contiguous enclosure comprising an interior volume of the plurality of shipping containers, wherein each of the plurality of shipping containers comprises a first side defining an opening configured to be arranged opposite and adjacent to a corresponding opening in a first side of a different shipping container of the plurality to form the contiguous enclosure;

a bottom group of the plurality of shipping containers comprising bottom sides having floor sections arranged to form a bottom floor of the modular structure;

a top group of the plurality of shipping containers comprising top sides having ceiling sections arranged to form a top ceiling of the modular structure;

a staircase spanning from the bottom floor toward the top ceiling and to or through a removable portion of at least one shipping container of the bottom group of the plurality of shipping containers that forms an opening, wherein the removable portion is sized and shaped to enable a user to walk up the staircase and though the opening when the removable portion is absent; and a side group of the plurality of shipping containers comprising a second side having a side wall arranged to form exterior right and left side walls of the modular structure, wherein the plurality of shipping containers are configured to be arranged and secured longitudinally adjacent to each other, and each shipping container comprises eight corners comprising corner casting, each shipping container is secured to one or more adjacent shipping containers by fasteners, and each fastener secures a corner of each shipping container to an adjacent and opposite corner of one of the one or more adjacent shipping containers.

22. The modular structure system of claim 21, wherein the modular structure defines an exterior surface comprising the walls of the plurality of shipping containers facing the exterior of the modular structure, and wherein the walls of the plurality of shipping containers forming the exterior surface comprise an insulating material disposed on an inner surface of the walls.

23. The modular structure system of claim 21, wherein an interior group of the plurality of shipping containers comprises a second side with an opening opposite the opening of the first side.

24. The modular structure system of claim 21, wherein the openings in the first sides span the entire first sides.

25. The modular structure system of claim 21, wherein the staircase comprises railings.

26. The modular structure system of claim 21, wherein one or more shipping containers comprises an exterior outlet configured to provide a utility connection to the modular structure.

27. A modular structure system comprising:

a plurality of shipping containers arranged to form a contiguous enclosure comprising an interior volume of the plurality of shipping containers, wherein each of the plurality of shipping containers comprises a first side defining an opening configured to be arranged opposite and adjacent to a corresponding opening in a first side of a different shipping container of the plurality to form the contiguous enclosure;

a bottom group of the plurality of shipping containers comprising bottom sides having floor sections arranged to form a bottom floor of the modular structure;

a top group of the plurality of shipping containers comprising top sides having ceiling sections arranged to form a top ceiling of the modular structure;

a side group of the plurality of shipping containers comprising a second side having a side wall arranged to form exterior right and left side walls of the modular structure; and a staircase spanning from the bottom floor toward the top ceiling and to or through a removable portion of at least one shipping container of the bottom group of the plurality of shipping containers that forms an opening, wherein the removable portion is sized and shaped to enable a user to walk up the staircase and though the opening when the removable portion is ab sent.

28. The modular structure system of claim 27, wherein the modular structure defines an exterior surface comprising the walls of the plurality of shipping containers facing the exterior of the modular structure, and wherein the walls of the plurality of shipping containers forming the exterior surface comprise an insulating material disposed on an inner surface of the walls.

29. The modular structure system of claim 27, wherein the plurality of shipping containers are configured to be arranged and secure longitudinally adjacent to each other.

30. The modular structure system of claim 27, wherein each shipping container comprises eight corners comprising corner casting, and wherein each shipping container is secured to one or more adjacent shipping containers by fasteners, wherein each fastener secures a corner of each shipping container to an adjacent and opposite corner of one of the one or more adjacent shipping containers.

31. The modular structure system of claim 27, wherein an interior group of the plurality of shipping containers comprises a second side with an opening opposite the opening of the first side.

32. The modular structure system of claim 27, wherein the openings in the first sides span the entire first sides.

33. The modular structure system of claim 27, wherein the staircase comprises railings.

34. The modular structure system of claim 33, wherein one or more shipping containers comprises an exterior outlet configured to provide a utility connection to the modular structure.

* * * * *